US012692116B2

(12) United States Patent
Fujiwara et al.

(10) Patent No.: US 12,692,116 B2
(45) Date of Patent: Jul. 28, 2026

(54) SHEET CONVEYANCE APPARATUS

(71) Applicant: BROTHER KOGYO KABUSHIKI KAISHA, Nagoya (JP)

(72) Inventors: Takashi Fujiwara, Nagakute (JP); Yoshihiro Okamoto, Komaki (JP); Shuhei Hatano, Komaki (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 10 days.

(21) Appl. No.: 19/038,809

(22) Filed: Jan. 28, 2025

(65) Prior Publication Data

US 2025/0368465 A1 Dec. 4, 2025

(30) Foreign Application Priority Data

Jan. 29, 2024 (JP) ..... 2024-011010

(51) Int. Cl.
*B65H 29/52* (2006.01)
*B65H 29/20* (2006.01)
*B65H 29/70* (2006.01)

(52) U.S. Cl.
CPC ..... *B65H 29/20* (2013.01); *B65H 29/52* (2013.01); *B65H 29/70* (2013.01)

(58) Field of Classification Search
CPC .... B65H 29/70; B65H 29/52; B65H 2404/61; B65H 2404/611; B65H 2404/6112
See application file for complete search history.

(56) References Cited

U.S. PATENT DOCUMENTS

| | | | | |
|---|---|---|---|---|
| 9,315,046 | B2 * | 4/2016 | Kodama | B41J 13/106 |
| 9,388,013 | B2 * | 7/2016 | Onishi | B65H 31/02 |
| 10,723,148 | B2 * | 7/2020 | Takeda | B65H 29/52 |
| 11,199,801 | B2 * | 12/2021 | Isobe | B65H 29/14 |
| 12,522,462 | B2 * | 1/2026 | Fujiwara | B65H 29/22 |
| 2012/0274021 | A1 * | 11/2012 | Nakamura | G03G 15/6552 271/220 |
| 2014/0292979 | A1 * | 10/2014 | Kodama | B65H 29/70 347/104 |
| 2017/0107071 | A1 | 4/2017 | Agata | |

(Continued)

FOREIGN PATENT DOCUMENTS

| | | | |
|---|---|---|---|
| JP | S63-169560 | U | 11/1988 |
| JP | 2001253613 | A | 9/2001 |

(Continued)

*Primary Examiner* — Patrick Cicchino
(74) *Attorney, Agent, or Firm* — Element IP, PLC

(57) ABSTRACT

A sheet conveyance apparatus includes a lower sheet guide including a first guide surface configured to guide a surface of a sheet, a discharge roller including two rollers configured to convey the sheet in a discharge direction, and a shaft extending in a width direction perpendicular to the discharge direction, a discharge tray configured to support the sheet, a first elastic piece located between the two rollers in the width direction and located above the shaft at a position of the shaft, a plurality of second elastic pieces located so as to sandwich the two rollers in the width direction and located above the shaft at the position of the shaft, a plurality of third elastic pieces located so as to sandwich the two rollers in the width direction and located downstream of the second elastic pieces in the discharge direction.

14 Claims, 13 Drawing Sheets

(56) References Cited

U.S. PATENT DOCUMENTS

| | | | | |
|---|---|---|---|---|
| 2017/0233212 | A1* | 8/2017 | Dransfield | B65H 29/14<br>271/220 |
| 2017/0248888 | A1* | 8/2017 | Izumichi | B65H 31/02 |
| 2020/0209799 | A1* | 7/2020 | Isobe | B65H 29/70 |

FOREIGN PATENT DOCUMENTS

| | | | |
|---|---|---|---|
| JP | 2002046920 | A | 2/2002 |
| JP | 2017077941 | A | 4/2017 |

* cited by examiner

SHEET CONVEYANCE APPARATUS

REFERENCE TO RELATED APPLICATIONS

This application claims priority from Japanese Patent Application No. 2024-011010 filed on Jan. 29, 2024. The entire content of the priority application is incorporated herein by reference.

BACKGROUND ART

A related art discloses a sheet discharge apparatus illustrated in FIGS. 2 and 3 and the like, which is an example of a sheet conveyance apparatus. This sheet discharge apparatus includes a sheet stacking unit, a first discharge roller body, a second discharge roller body, a first rotating shaft, and a second rotating shaft.

The sheet stacking unit supports a sheet to be discharged. The first discharge roller body and the second discharge roller body convey the sheet in a discharge direction. Each of the first rotating shaft and the second rotating shaft extends in a width direction perpendicular to the discharge direction. The first rotating shaft is located above the second rotating shaft. The first discharge roller body is rotated integrally with the first rotating shaft. The second discharge roller body is rotated integrally with the second rotating shaft. The first discharge roller body is shifted in the width direction relative to the second discharge roller body. The lower end of the outer circumferential surface of the first discharge roller body is located below the upper end of the outer circumferential surface of the second discharge roller body.

When the sheet is conveyed, the first discharge roller body and the second discharge roller body deform the sheet into a wavy shape when viewed in the discharge direction, thereby increasing rigidity of the sheet and stabilizing the position of the sheet when the sheet is discharged. In this manner, this sheet discharge apparatus is configured to improve stacking performance of the sheets to be discharged onto the sheet stacking unit.

However, in the sheet discharge apparatus described above, since the first rotating shaft and the first discharge roller body are configured to be located above the second rotating shaft, it is difficult to achieve a thin configuration in the upward-and-downward direction of the sheet discharge apparatus.

An object thereof is to provide a sheet conveyance apparatus capable of achieving, with a simple configuration, a thin vertical configuration and improved stacking performance of sheets to be discharged onto a discharge tray.

SUMMARY

A sheet conveyance apparatus includes: a lower sheet guide including a first guide surface configured to guide a surface of a sheet, the surface facing downwards; a discharge roller including: two rollers configured to convey the sheet guided by the first guide surface in a discharge direction, a part of each of the two rollers protruding above the first guide surface; and a shaft extending in a width direction perpendicular to the discharge direction, the two rollers being spaced apart from each other in the width direction and being rotated integrally with the shaft; a discharge tray configured to support the sheet guided by the first guide surface and discharged from the discharged roller; a first elastic piece located between the two rollers in the width direction and located above the shaft at a position of the shaft, the first elastic piece protruding in a first direction along the discharge direction, the first direction being perpendicular to the width direction; a plurality of second elastic pieces located so as to sandwich the two rollers in the width direction and located above the shaft at the position of the shaft, the second elastic pieces protruding in the first direction; and a plurality of third elastic pieces located so as to sandwich the two rollers in the width direction and located downstream of the second elastic pieces in the discharge direction, the third elastic pieces protruding in a second direction from a position above the first elastic piece and the second elastic pieces, the second direction being perpendicular to the width direction and inclined downwards toward the discharge direction, in which surfaces of the first elastic piece and the second elastic pieces are contact surfaces configured to contact the sheet guided by the first guide surface, the surfaces facing downwards, in a state where the contact surfaces are not in contact with the sheet guided by the first guide surface, portions of the respective contact surfaces are located below upper ends of outer circumferential surfaces of the respective two rollers, the portions being located directly above the shaft, and downstream ends of the third elastic pieces in the second direction are located downstream in the discharge direction of and located below a downstream end of the first elastic piece in the first direction and downstream ends of the second elastic pieces in the first direction.

BRIEF DESCRIPTION OF DRAWINGS

FIG. 4 is a partial top view illustrating a discharge roller, first to third elastic pieces, a discharge tray, and the like;

FIG. 6 is a perspective view illustrating the first tray member, an interlocking mechanism, the third elastic piece, and the like;

FIG. 7 is a partial perspective view illustrating the discharge roller, the first and second elastic pieces, first and second discharge members, the discharge tray, and the like;

DESCRIPTION

Hereinafter, first and second embodiments of the present disclosure will be described with reference to the drawings.

First Embodiment

Figure 1:
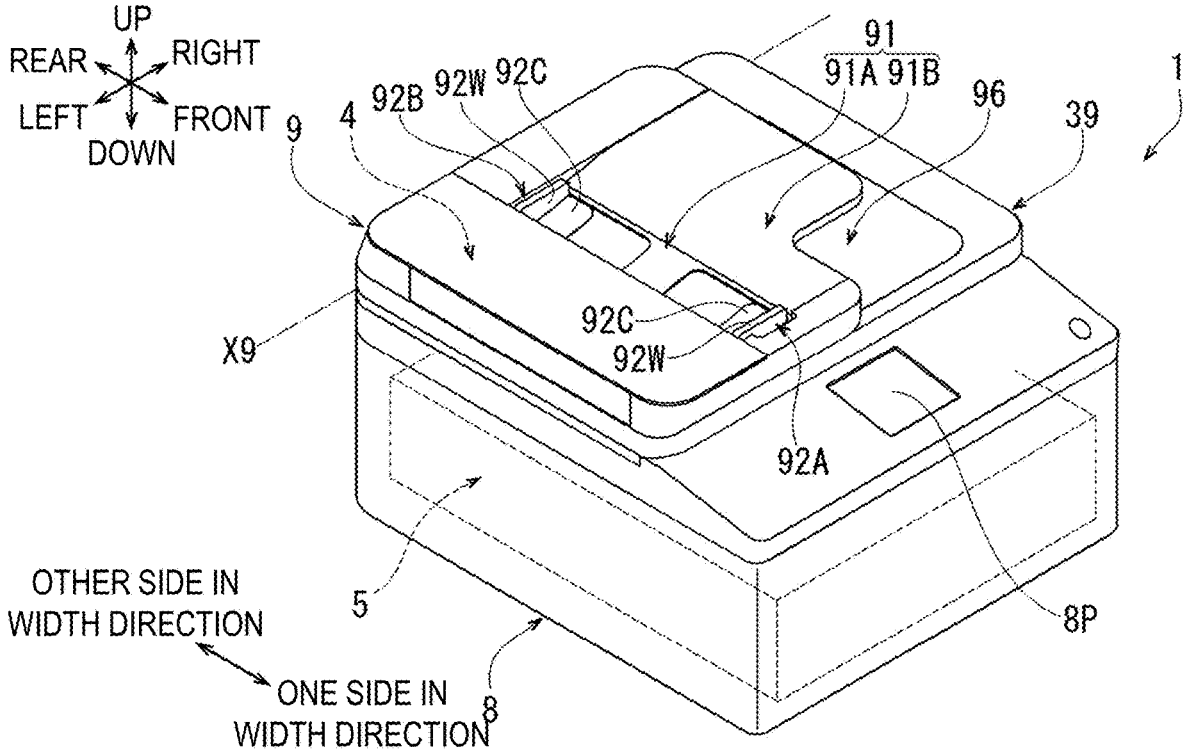
FIG. 1 is a perspective view of an image reading apparatus according to a first embodiment.

As illustrated in FIG. 1, an image reading apparatus 1 of a first embodiment is an example of a specific aspect of a sheet conveyance apparatus of the present disclosure.

In FIG. 1, a side of an operation panel 8P of the image reading apparatus 1 is defined as a front side. The left side of the operation panel 8P is defined as a left side. A forward-and-rearward direction, a leftward-and-rightward direction, and an upward-and-downward direction illustrated in each of FIGS. 2 to 11 are all displayed corresponding to the respective directions illustrated in FIG. 1.

<Overall Configuration>

Figure 2:
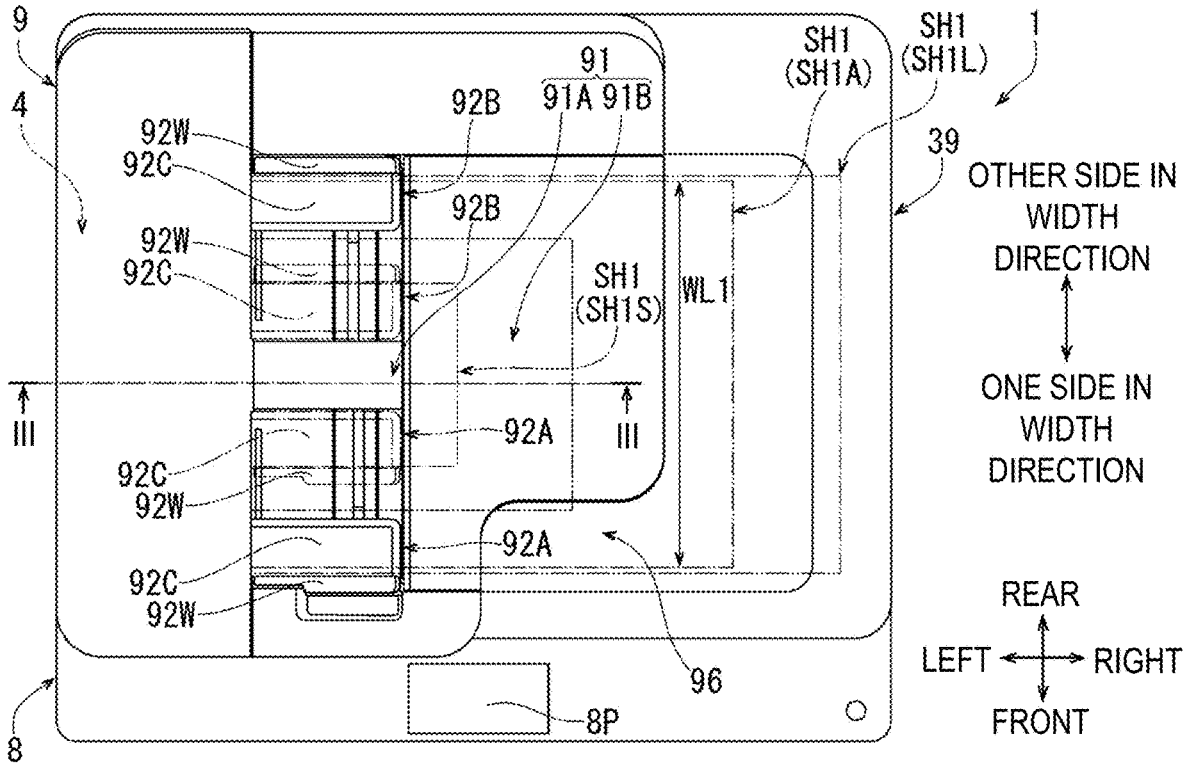
FIG. 2 is a top view of the image reading apparatus according to the first embodiment.

As illustrated in FIGS. 1 and 2, the image reading apparatus 1 includes a main body 8 and a cover 9. The main body 8 is a flat body and has an approximately box shape. The operation panel 8P, such as a touch panel, is located on the front surface of the main body 8. The main body 8 houses an image forming unit 5 in a lower portion of the main body 8. The image forming unit 5 forms an image on a sheet using an inkjet system or a laser system.

Figure 3:
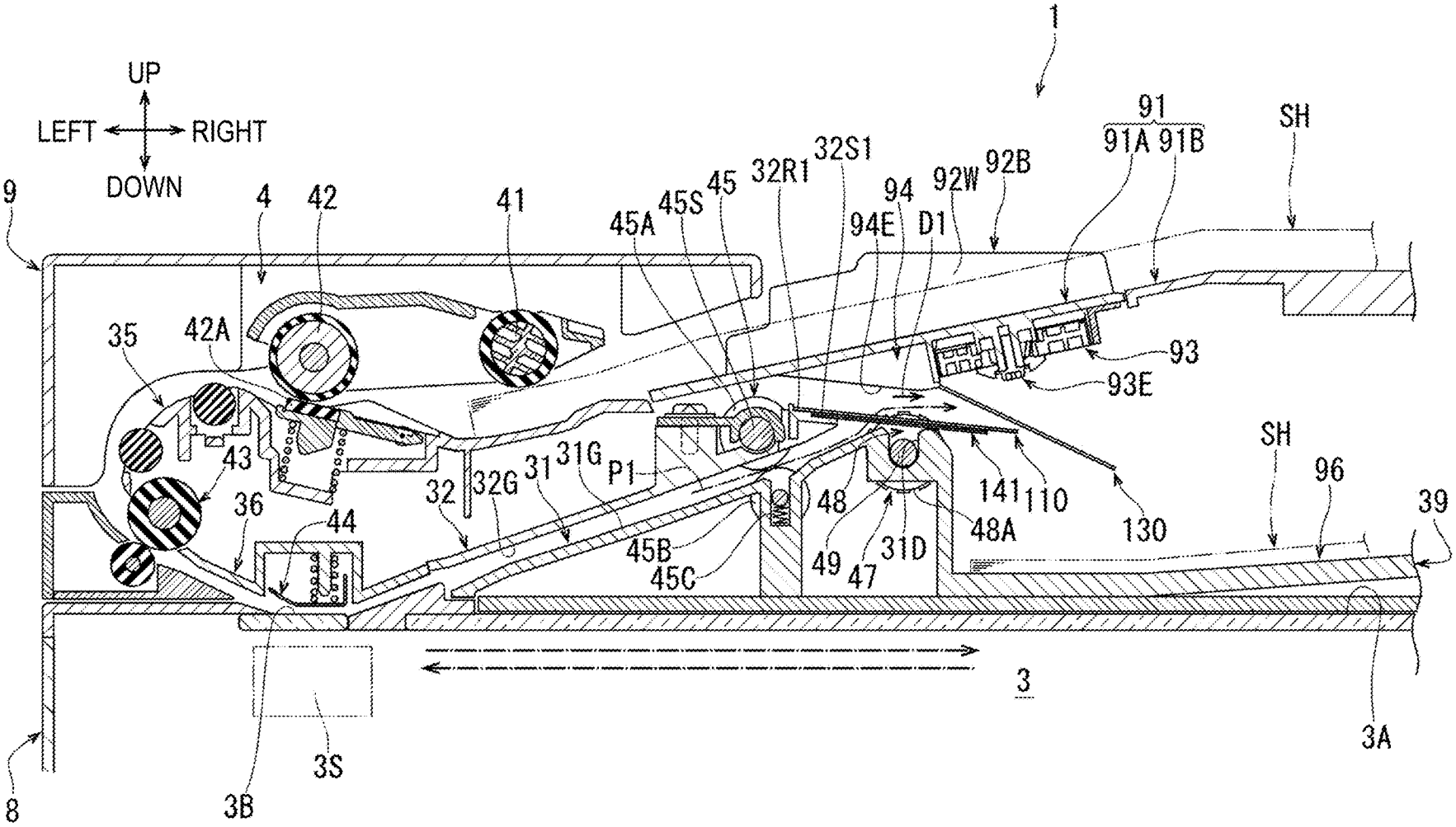
FIG. 3 is a schematic partial cross-sectional view illustrating a cross section taken along line III-III in FIG. 2 and FIG. 4.

As illustrated in FIG. 3, the main body 8 houses an image reading unit 3 in an upper portion of the main body 8. The image reading unit 3 includes a document support surface 3A, a reading surface 3B, a reading sensor 3S, and a scanning mechanism that is not illustrated.

The document support surface 3A is the upper surface of a large-area platen glass located on the upper surface of the main body 8. The reading surface 3B is the upper surface of the platen glass located to the left of the document support surface 3A on the upper surface of the main body 8 and formed to extend in a long and narrow manner in the forward-and-rearward direction.

The document support surface 3A is configured to support a subject document from which an image is to be read. The subject document can be paper, a sheet such as an OHP sheet, a book, and the like. The reading surface 3B is used in a case where a conveyance unit 4, which will be described later, is in operation.

The reading sensor 3S is a well-known image reading sensor such as a contact image sensor (CIS) or a charge coupled device (CCD), and extends in a long and narrow manner in the forward-and-rearward direction. The reading sensor 3S is located below the document support surface 3A and the reading surface 3B.

In a case where the image reading unit 3 reads the image of the document supported on the document support surface 3A, the reading sensor 3S reads the image of the document in a line shape in the forward-and-rearward direction, that is, a main scanning direction, while moving from below the left end edge of the document support surface 3A to the right, that is, in a sub-scanning direction, by the operation of the scanning mechanism not illustrated. When the reading sensor 3S moves to below the right end edge of the document support surface 3A, the reading sensor stops reading the image and returns to a standby position by the operation of the scanning mechanism not illustrated.

In a case where the conveyance unit 4, which will be described later, is operated, the reading sensor 3S moves to a stationary reading position below the reading surface 3B by the operation of the scanning mechanism not illustrated and stops at the stationary reading position.

As illustrated in FIG. 1, the cover 9 is located above the main body 8. The rear end of the cover 9 is connected to the rear end of the main body 8 using a hinge not illustrated. The cover 9 is configured to be swung around a swing axis X9 extending in the leftward-and-rightward direction.

As illustrated in FIG. 3, the cover 9 includes a resin base member 39. The lower surface of the base member 39 forms the bottom surface of the cover 9. The bottom surface of the cover 9 is large enough to cover the document support surface 3A and the reading surface 3B. The bottom surface of the cover 9 is configured to cover the document placed on the document support surface 3A.

Although not illustrated in the drawing, a user swings the cover 9 upwards and rearwards around the swing axis X9, thereby causing the cover 9 to open the document support surface 3A. In this state, the user can place a document on the document support surface 3A and remove the document therefrom.

As illustrated in FIGS. 1 to 3, the cover 9 includes a supply tray 91 and a discharge tray 96. The supply tray 91 and the discharge tray 96 are located on the right side of the cover 9.

Figure 4:
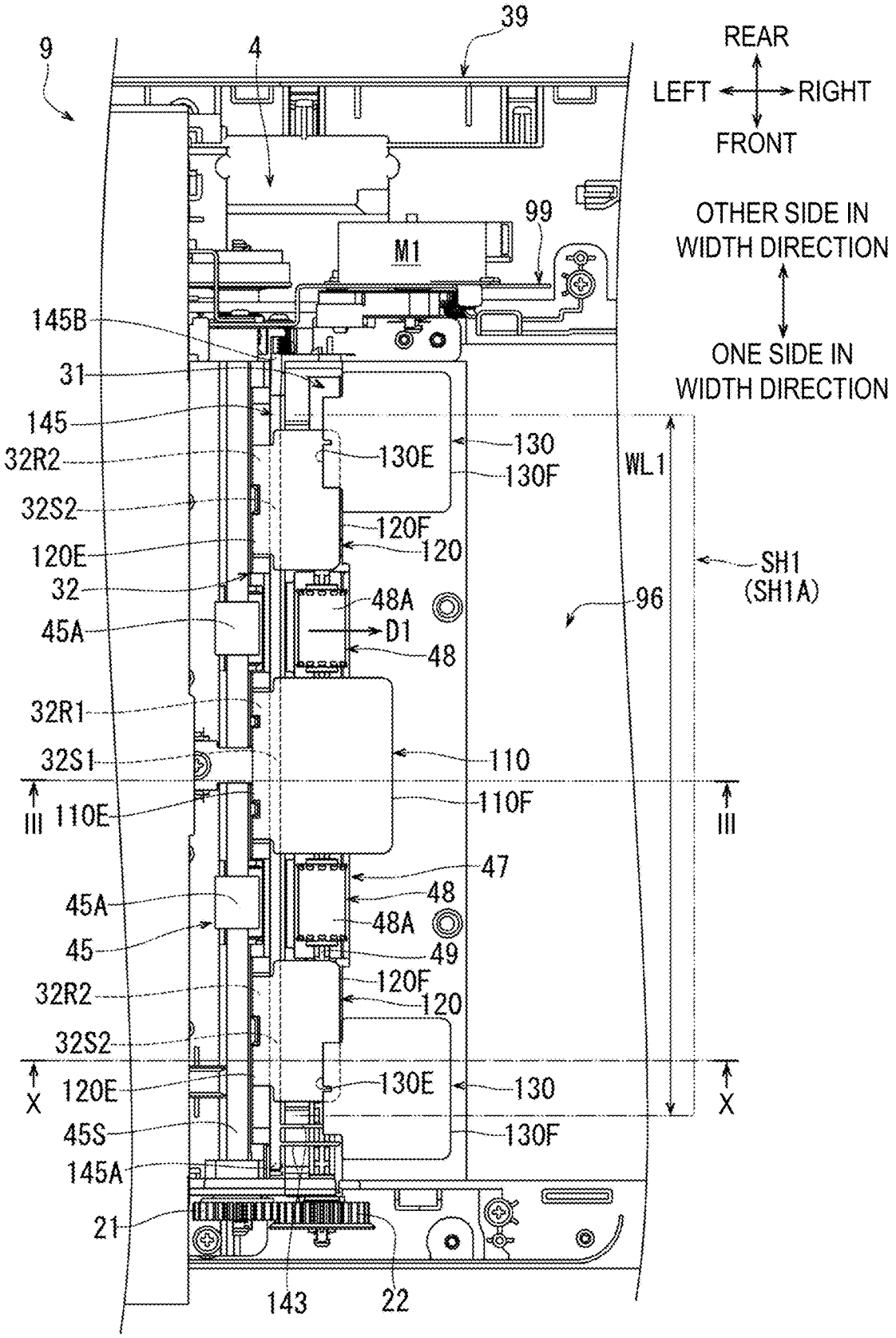

As illustrated in FIGS. 3 and 4, the upper surface of the right side of the base member 39 forms the discharge tray 96. The discharge tray 96 is configured to support a sheet SH1 conveyed and discharged by the conveyance unit 4 to be described below.

As illustrated in FIG. 3, the supply tray 91 is located above the discharge tray 96. The supply tray 91 includes a first tray member 91A and a second tray member 91B.

Figure 5:
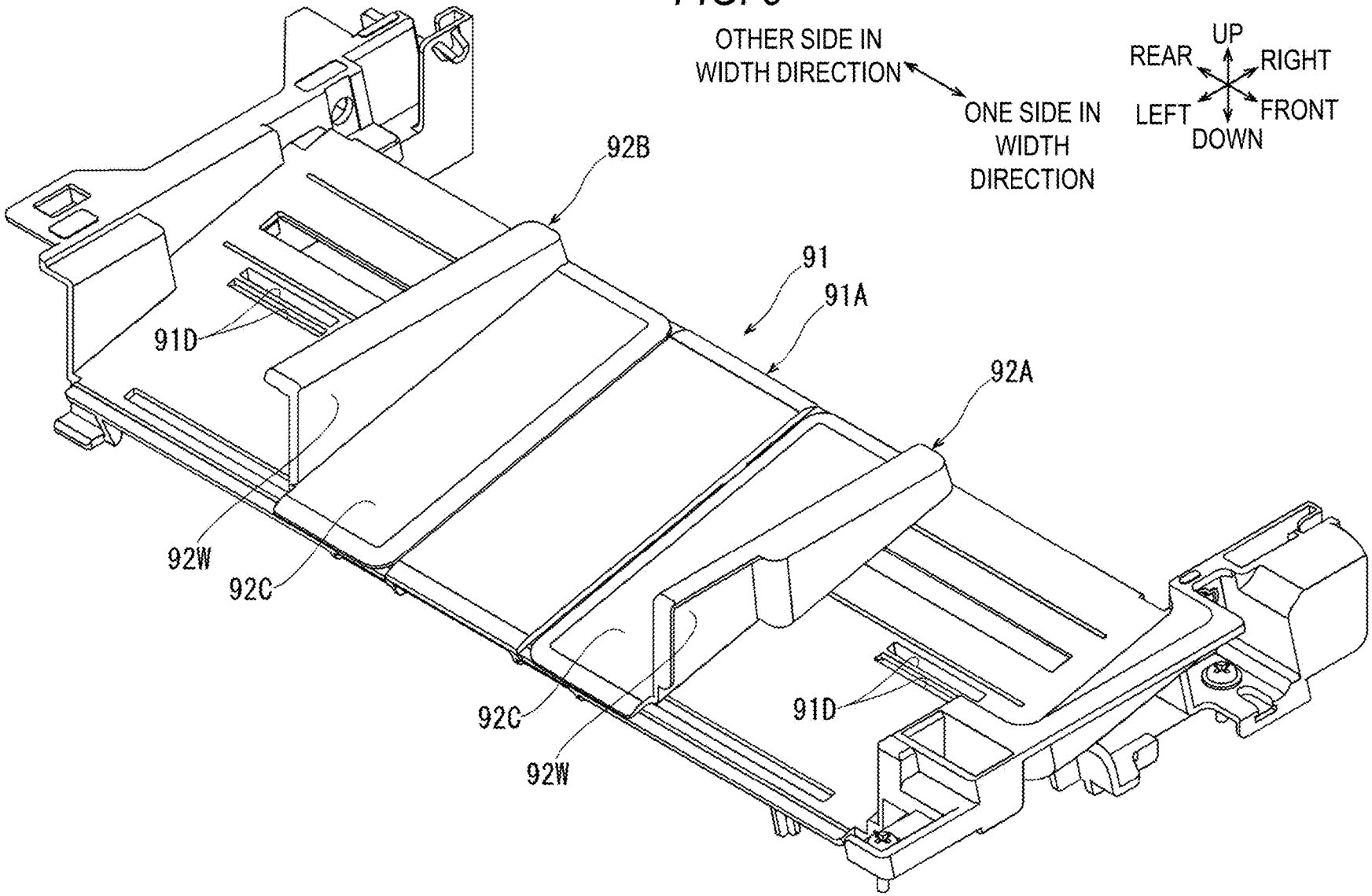
FIG. 5 is a perspective view illustrating a first tray member constituting a part of a supply tray, and two side guides.
Figure 6:
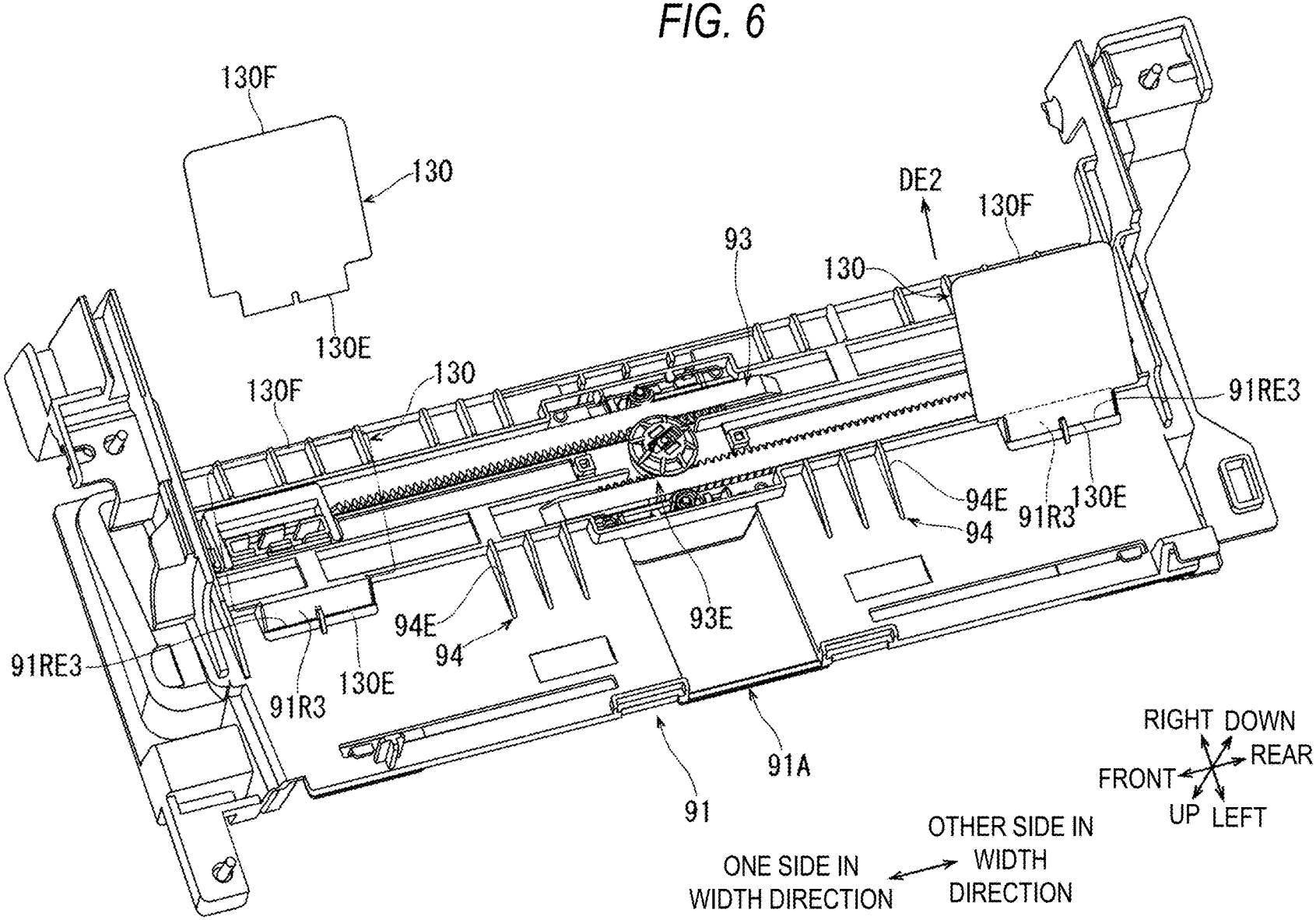

As illustrated in FIGS. 5 and 6, the first tray member 91A has a flat plate shape extending in the forward-and-rearward direction and the leftward-and-rightward direction, and has a pair of coupling parts respectively formed at the front and rear ends of the first tray member 91A. Although not illustrated in the drawing, the first tray member 91A is coupled to the base member 39 by coupling the pair of coupling parts to the base member 39.

As illustrated in FIG. 3, the second tray member 91B is located to the right of the first tray member 91A. The upper surface of the first tray member 91A and the upper surface of the second tray member 91B form a sheet placement surface of the supply tray 91.

The sheet placement surface of the supply tray 91 extends so as to be inclined downwards in the left direction and also extends in the forward-and-rearward direction. The sheets SH1 to be read are placed in a stacked state, on the supply tray 91. The width direction of the sheets SH1 placed on the supply tray 91 is the same as the width direction perpendicular to a discharge direction D1 to be described later. That is, the width direction of the sheets SH1 placed on the supply tray 91 is the forward-and-rearward direction. In the present embodiment, one of the width directions is the front side, and the other width direction is the rear side.

In the present embodiment, an object, of which the image is read using the document support surface 3A, is described as a document, and an object placed on the supply tray 91 and whose image is read while being conveyed by the conveyance unit 4 is described as the sheet SH1. The document and the sheet SH1 may be substantially the same.

As illustrated in FIGS. 2 and 5, the supply tray 91 includes two side guides 92A and 92B. Each of the side guides 92A and 92B is located on the sheet placement surface of the supply tray 91. Each of the side guides 92A and 92B has substantially the same configuration, which is symmetry, as each other and has a guide wall 92W and a sheet end edge support part 92C.

The sheet end edge support part 92C of each of the side guides 92A and 92B is supported by the first tray member 91A so as to be slide in the forward-and-rearward direction, which is a width direction. The guide wall 92W of the side guide 92A is connected to the front end edge of the sheet end edge support part 92C of the side guide 92A, protrudes upwards, and extends in the leftward-and-rightward direction. The guide wall 92W of the side guide 92B is connected to the rear end edge of the sheet end edge support part 92C of the side guide 92B, protrudes upwards, and extends in the leftward-and-rightward direction.

As illustrated in FIG. 3 and FIG. 6, the supply tray 91 includes an interlocking mechanism 93. The interlocking mechanism 93 includes a first rack configured to slide integrally with the side guide 92A, a second rack configured to slide integrally with the side guide 92B, and a pinion gear configured to mesh with the first rack and the second rack. An exposed portion of the first rack, the second rack, and the pinion gear on the back surface side of the supply tray 91 is an exposed portion 93E of the interlocking mechanism 93.

As illustrated in FIG. 1 to FIG. 3 and FIG. 5, the interlocking mechanism 93 is configured to move the side guides 92A and 92B to be closer to each other and to be spaced apart from each other in the forward-and-rearward direction.

Each of the side guides 92A and 92B positions the sheets SH1 having various sizes placed on the supply tray 91 by sandwiching the sheets in the forward-and-rearward direction (width direction) between the respective guide walls 92W.

At this time, the sheet end edge support part 92C of the side guide 92A supports an end edge located on one side of the sheet SH1 in the width direction from below. The sheet end edge support part 92C of the side guide 92B supports an end edge located on the other side of the sheet SH1 in the width direction from below.

In the present embodiment, the sheet SH1 to be image-read includes A6 to A4 size paper and legal size paper.

The positions of the side guides 92A and 92B illustrated in FIG. 1 and the positions of the side guides 92A and 92B illustrated by solid lines in FIG. 2 are the positions at which the side guides 92A and 92B are maximally spaced apart from each other in the forward-and-rearward direction. In a case where the side guides 92A and 92B are respectively located in the positions illustrated by solid lines in FIG. 2, the position of a largest sheet SH1L, which is the largest length in the width direction, is determined in the forward-and-rearward direction (width direction) in a state in which the sheet SH1L is sandwiched between the side guides 92A and 92B.

The positions of the side guides 92A and 92B illustrated by the two-dot chain lines in FIG. 2 and the positions of the side guides 92A and 92B illustrated in FIG. 5 are the positions at which the side guides 92A and 92B are closest to each other in the forward-and-rearward direction. When the side guides 92A and 92B are respectively located in the positions illustrated by the two-dot chain lines in FIG. 2, the position of a smallest sheet SH1S, which is the smallest length in the width direction, is determined in the forward-and-rearward direction (width direction) in a state in which the sheet SH1S is sandwiched between the side guides 92A and 92B.

As illustrated in FIG. 2, the image reading apparatus 1 is configured to place, on the supply tray 91, the sheets SH1 having multiple sizes that include the largest sheet SH1L, a specific sheet SH1A in which the widthwise length is a predetermined length WL1, and the smallest sheet SH1S, and is configured to discharge the sheets SH1 toward the discharge tray 96.

In the present embodiment, the largest sheet SH1L is legal size paper, the specific sheet SH1A is A4 size paper which is frequently used, and the smallest sheet SH1S is A6 size paper.

As illustrated in FIG. 3, the cover 9 includes the conveyance unit 4, a first conveyance guide 35, a second conveyance guide 36, a lower sheet guide 31, and an upper sheet guide 32. The conveyance unit 4, the first conveyance guide 35, the second conveyance guide 36, the lower sheet guide 31, and the upper sheet guide 32 are located inside a left portion of the cover 9.

The conveyance unit 4 includes a feed roller 41, a separation roller 42, a separation pad 42A, a pair of first conveyance rollers 43, a pressing member 44, and a pair of second conveyance rollers 45. The conveyance unit 4 includes a discharge roller 47 illustrated in FIGS. 3, 4, 7, and 8.

As illustrated in FIG. 3, the feed roller 41 is located so as to contact, from above, the sheet SH1 placed on the sheet placement surface of the supply tray 91. The separation roller 42 and the separation pad 42A are located to the left side of the feed roller 41. The pair of first conveyance rollers 43 is located on the left side wall of the cover 9 and close to the upper surface of the main body 8. The pressing member 44 is located directly above the reading surface 3B.

The first conveyance guide 35 and the second conveyance guide 36 are formed of parts of multiple chute members located inside the cover 9, ribs protruding downwards from the back surface of the upper wall member of the cover 9, and the like.

The first conveyance guide 35 is configured to guide the sheet SH1 from the left end of the supply tray 91 to the pair of first conveyance rollers 43.

The second conveyance guide 36 is configured to guide the sheet SH1 from the pair of first conveyance rollers 43 to the reading surface 3B in a state of being inclined downwards, and then to guide the sheet SH to pass through a space between the pressing member 44 and the reading surface 3B, that is, above the reading sensor 3S located at the stationary reading position.

<Lower Sheet Guide and Upper Sheet Guide>

The lower sheet guide 31 is formed on a left portion of the base member 39. The lower sheet guide 31 includes a first guide surface 31G. The first guide surface 31G is an inclined surface that faces upwards and extends from a position to the right side of the reading surface 3B so as to be inclined upwards to the right side, and also extends in the forward-and-rearward direction. The first guide surface 31G is configured to guide the downwardly facing surface of the sheet SH1 that has passed through a portion located above the reading sensor 3S.

The upper sheet guide 32 is located above the lower sheet guide 31. The upper sheet guide 32 includes a second guide surface 32G. The second guide surface 32G faces the first guide surface 31G of the lower sheet guide 31 from above. The second guide surface 32G is an inclined surface that faces downwards and extends from a position to the right side of the reading surface 3B so as to be inclined upwards to the right side, and also extends in the forward-and-rearward direction. The second guide surface 32G is configured to guide the upwardly facing surface of the sheet SH1 that has passed through a portion located above the reading sensor 3S.

A discharge path P1 is provided between the first guide surface 31G of the lower sheet guide 31 and the second guide surface 32G of the upper sheet guide 32, in which the sheet SH1 is discharged through the discharge path P1 toward the discharge tray 96. The first guide surface 31G and the second guide surface 32G guide the sheet SH1 that has passed through a portion located above the reading sensor 3S along the discharge path P1.

Figure 8:
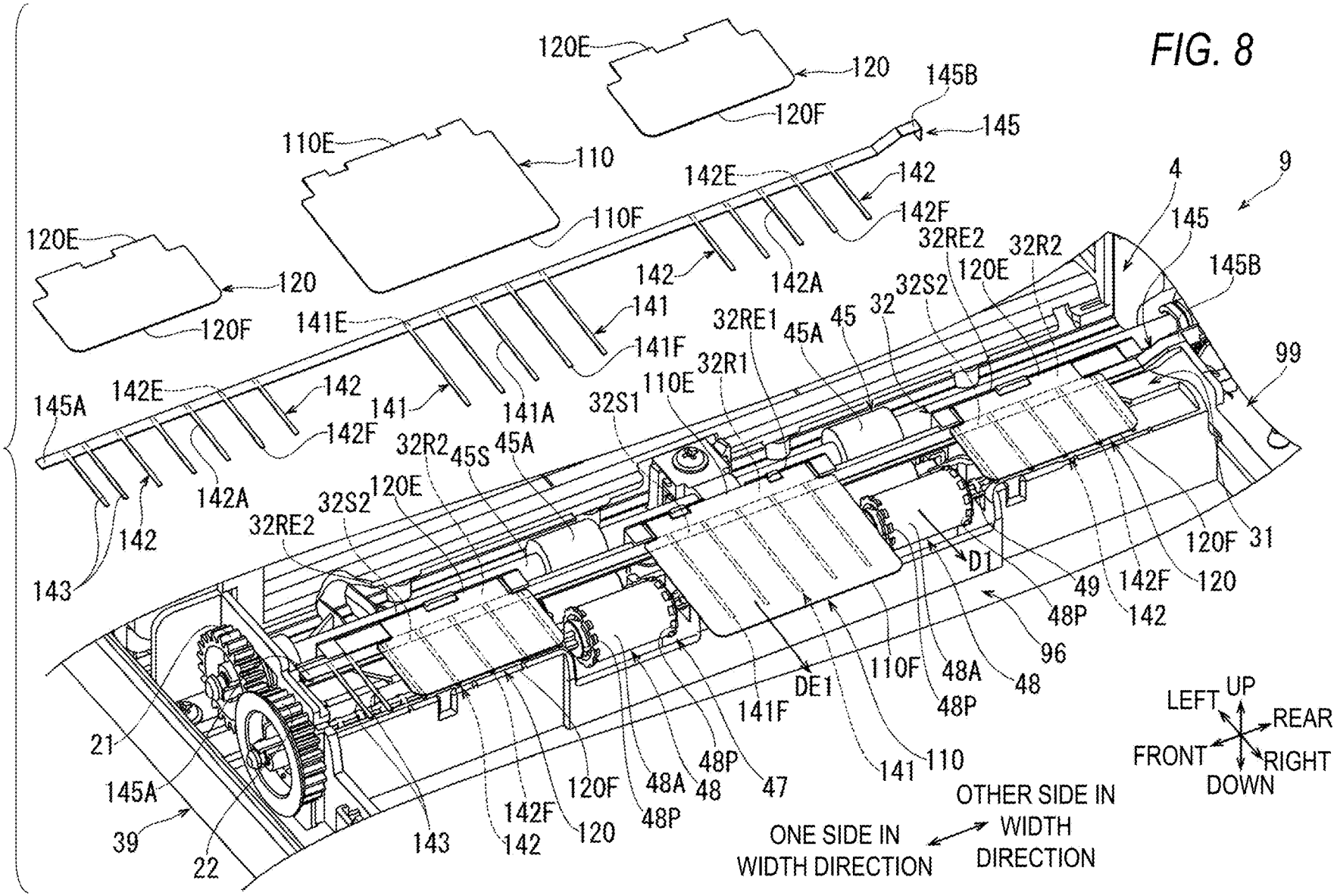
FIG. 8 is a partial perspective view of an enlarged main part in FIG. 7.

As illustrated in FIGS. 3 and 8, the lower sheet guide 31 has a shaft housing 31D. The shaft housing 31D is a groove that is recessed downwards near the rear end of the first guide surface 31G and extends in the forward-and-rearward direction. The first guide surface 31G extends in a short direction to the right side of the shaft housing 31D in a substantially horizontal direction, and then curves downwards to reach the rear end.

The sheet SH1 guided by the first guide surface 31G and the second guide surface 32G is guided in the discharge direction D1 at a rear end portion of the first guide surface 31G. The discharge direction D1 is a direction that advances substantially horizontally to the right side and is perpendicular to the width direction.

<Drive Motor and Drive Frame>

Figure 7:
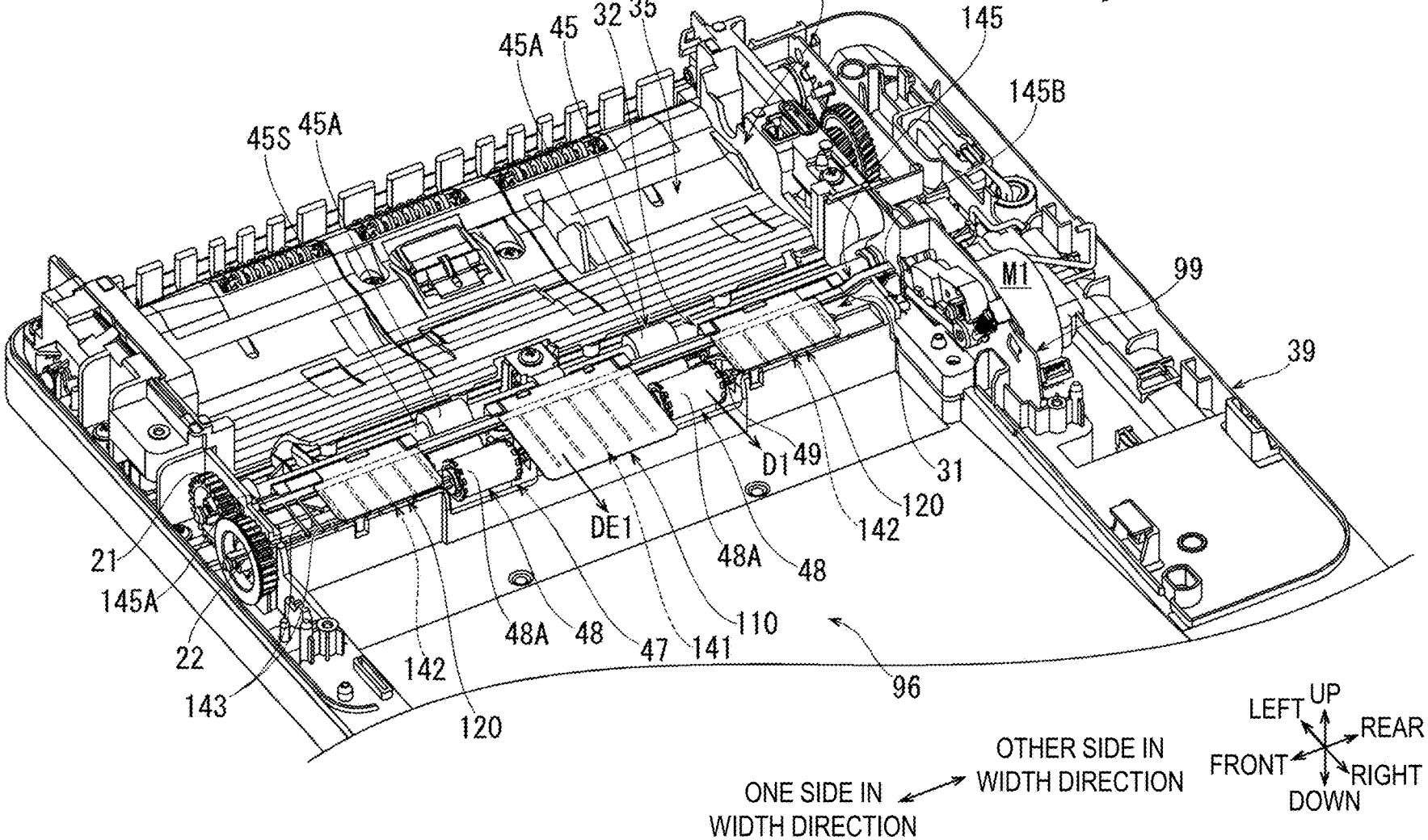

As illustrated in FIG. 7, the conveyance unit 4 includes a drive motor M1 and a drive frame 99. The drive motor M1 and the drive frame 99 are housed in the left portion of the rear end of the cover 9. The drive motor M1 and the drive frame 99 are located on the other side in the width direction of the first guide surface 31G of the lower sheet guide 31 and the second guide surface 32G of the upper sheet guide 32, that is, on the other side in the width direction of the discharge path P1.

The drive motor M1 is configured to generate driving force that is transmitted to the feed roller 41, the separation roller 42, the pair of first conveyance rollers 43, the pair of second conveyance rollers 45, and the discharge roller 47.

The drive frame 99 is made of a conductive material and is connected to earth. Specifically, the drive frame 99 is made by punching and bending a steel plate. The drive frame 99 supports the drive motor M1 and also supports a transmission mechanism consisting of a plurality of gears and the like.

<Pair of Second Conveyance Rollers>

As illustrated in FIG. 3, the pair of second conveyance rollers 45 is located in the middle of the discharge path P1 and is located upstream of the discharge roller 47 in the discharge direction D1. The pair of second conveyance rollers 45 includes a drive shaft 45S, two drive rollers 45A, and a driven roller 45B.

The drive shaft 45S is located above the second guide surface 32G of the upper sheet guide 32 and extends in the width direction. As illustrated in FIG. 7, the drive rollers 45A are fixed to the drive shaft 45S at positions spaced apart from each other in the width direction.

A first gear 21 is fixed to one end of the drive shaft 45S in the width direction. The first gear 21 is located on one side in the width direction from the first guide surface 31G and the second guide surface 32G, that is, on one side in the width direction from the discharge path P1.

The drive frame 99 rotatably supports the other end in the width direction of the drive shaft 45S. The driving force transmitted from the drive motor M1 to the pair of second conveyance rollers 45 and the discharge roller 47 is first transmitted to the drive shaft 45S. Each of the drive roller 45A and the first gear 21 is configured to be rotated integrally with the drive shaft 45S.

As illustrated in FIG. 3, the driven roller 45B is located on a side of the first guide surface 31G of the lower sheet guide 31 and faces the drive roller 45A. A biasing spring 45C is configured to presses the driven roller 45B toward the drive roller 45A.

The pair of second conveyance rollers 45 is configured to convey the sheet SH1 guided by the first guide surface 31G and the second guide surface 32G toward the discharge roller 47.

<Discharge Roller>

As illustrated in FIG. 3, the discharge roller 47 includes a shaft 49 and two rollers 48. The shaft 49 is housed in the shaft housing 31D of the lower sheet guide 31, is located below the first guide surface 31G, and is formed to extend in the width direction.

As illustrated in FIG. 4 and FIG. 8, the respective two rollers 48 are fixed to the shaft 49 located at positions separated from each other in the width direction. Each of the rollers 48 is made of rubber, and, in the present embodiment, is made of ethylene propylene diene rubber (EPDM). The outer circumferential surface 48A of each of the rollers 48 is a cylindrical surface that extends in the width direction without any steps or irregularities.

Figure 9:
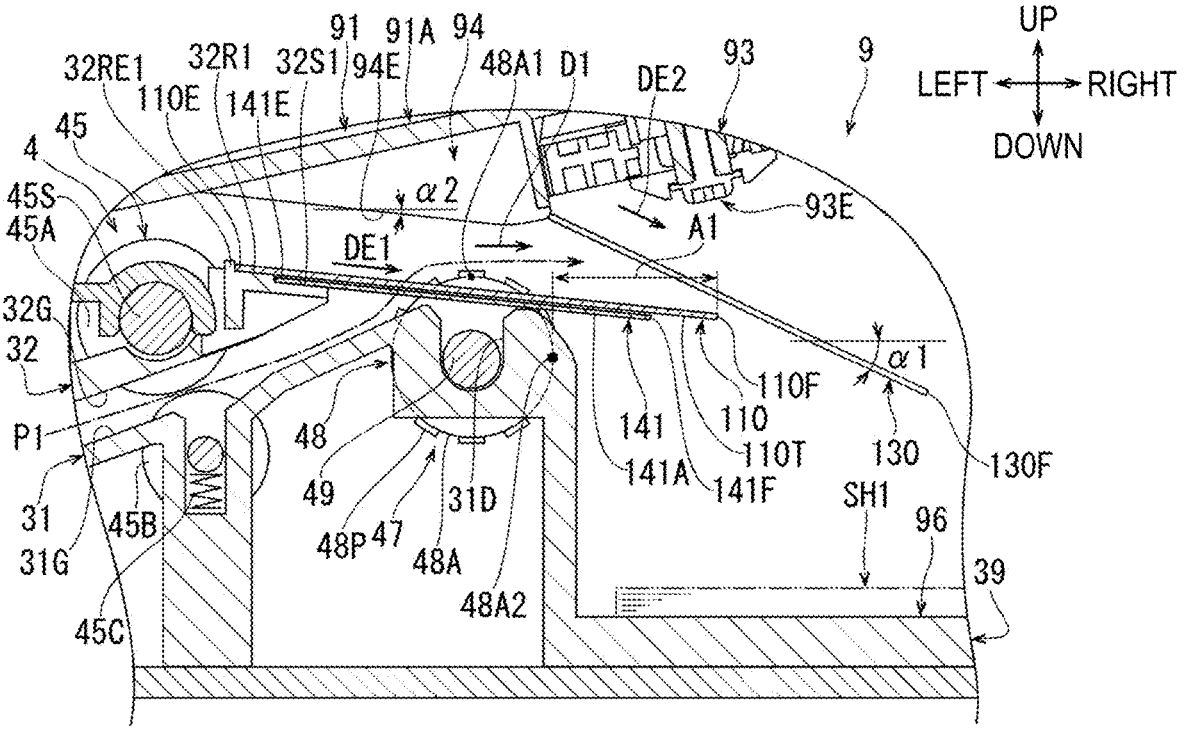
FIG. 9 is a schematic partial cross-sectional view of an enlarged main part in FIG. 3.
Figure 10:
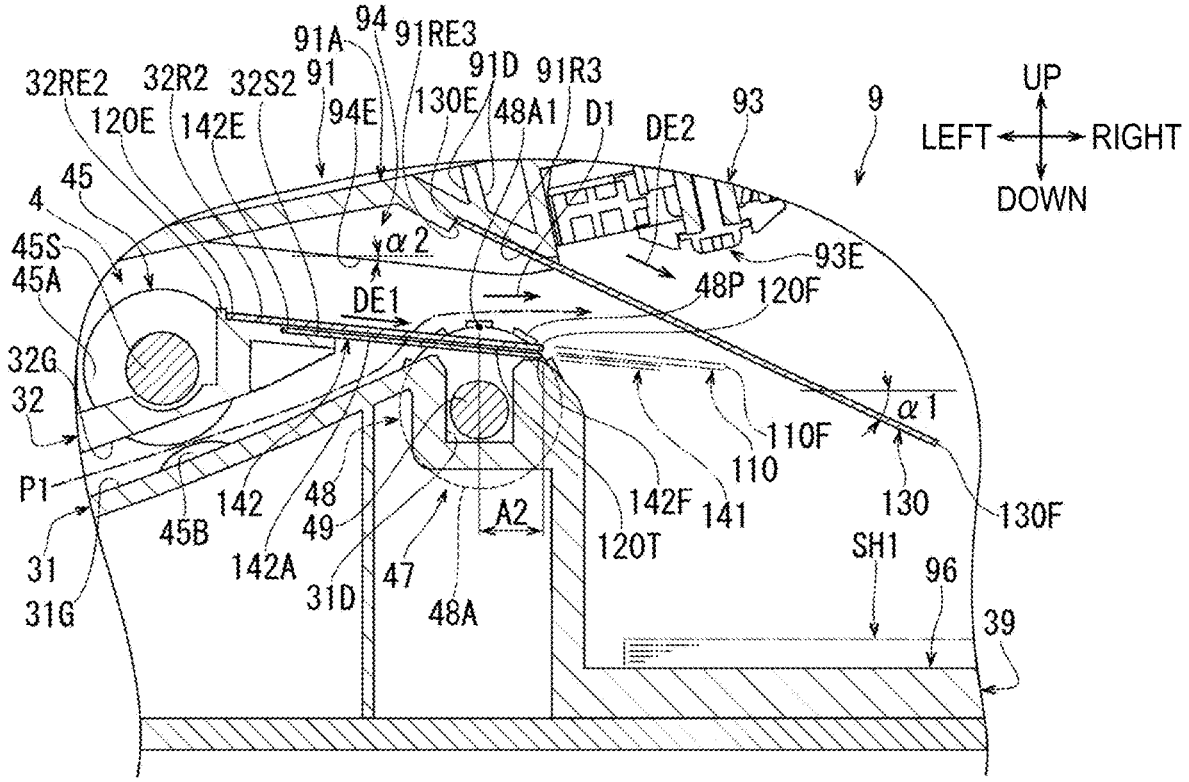
FIG. 10 is a schematic partial cross-sectional view illustrating a cross section taken along line X-X in FIG. 4.

As illustrated in FIGS. 9 and 10, a part of each of the rollers 48 protrudes upwards from the first guide surface 31G at an upper end 48A1 side of the outer circumferential surface 48A.

As illustrated in FIG. 8, the discharge roller 47 includes a paddle 48P. The paddle 48P protrudes radially outwards from one and the other circumferential end edges in the width direction of the outer circumferential surface 48A of each of the rollers 48, and is formed of a plurality of protrusions arranged with intervals therebetween in the circumferential direction of the shaft 49.

In a case where each of the rollers 48 finishes conveying the sheet SH1, the paddle 48P abuts the rear end of the sheet SH1 using the protrusions formed thereon, and feeds the sheet SH1 out toward the discharge tray 96.

A second gear 22 is fixed to one end of the shaft 49 in the width direction. The second gear 22 is located on one side of the discharge path P1 in the width direction and meshes with the first gear 21.

The driving force of the drive motor M1 is transmitted to the shaft 49 via the drive shaft 45S, the first gear 21, and the second gear 22. Each of the rollers 48 is configured to be rotated integrally with the second gear 22 and the shaft 49.

Each of the rollers 48 is configured to convey the sheet SH1 guided by the first guide surface 31G and the second guide surface 32G in the discharge direction D1 and is configured to discharge the sheet SH1 onto the discharge tray 96. Since the vertical position of each of the rollers 48 is higher than the position of the driven roller 45B, the amount of sheets SH1 that can be stacked onto the discharge tray 96 increases by a vertical position difference between each of the rollers and the driven roller.

<First Elastic Piece Holding Part and First Discharge Member Holding Part>

As illustrated in FIGS. 8 and 9, the upper sheet guide 32 includes a first elastic piece holding part 32R1 and a first discharge member holding part 32S1.

As illustrated in FIG. 8, the first elastic piece holding part 32R1 and the first discharge member holding part 32S1 are located between the drive roller 45A and roller 48 located on one side in the width direction and the drive roller 45A and roller 48 located on the other side in the width direction.

As illustrated in FIG. 9, the first elastic piece holding part 32R1 is located downstream of the drive shaft 45S in the discharge direction D1 and is located above the drive shaft 45S. The first elastic piece holding part 32R1 is an upwardly facing flat surface extending in the width direction and a first direction DE1. The first direction DE1 is perpendicular to the width direction and is along the discharge direction D1, and is gently inclined downwards in the right direction. When viewed in the width direction, the first direction DE1 intersects the discharge direction D1 at a small angle. An abutting part 32RE1 extending in the width direction is provided at the upstream end of the first elastic piece holding part 32R1 in the discharge direction D1.

The first discharge member holding part 32S1 is located downstream of the first elastic piece holding part 32R1 in the first direction DE1 and is located one step lower than the first elastic piece holding part 32R1. The first discharge member holding part 32S1 is an upwardly facing flat surface extending in the width direction and the first direction DE1.

<Second Elastic Piece Holding Part and Second discharge Member Holding Part>

As illustrated in FIGS. 8 and 10, the upper sheet guide 32 includes two second elastic piece holding parts 32R2 and two second discharge member holding parts 32S2.

As illustrated in FIG. 8, the second elastic piece holding part 32R2 and the second discharge member holding part 32S2 located on one side in the width direction are located on one side in the width direction with respect to the drive roller 45A and the roller 48 located on one side in the width direction. The second elastic piece holding part 32R2 and the second discharge member holding part 32S2 located on the other side in the width direction are located on the other side in the width direction with respect to the drive roller 45A and the roller 48 located on the other side in the width direction.

As illustrated in FIG. 10, each of the second elastic piece holding parts 32R2 is located downstream of the drive shaft 45S in the discharge direction D1 and is located above the drive shaft 45S. Each of the second elastic piece holding parts 32R2 is an upwardly facing flat surface extending in the width direction and the first direction DE1. An abutting part 32RE2 extending in the width direction is provided at the upstream end of each of the second elastic piece holding parts 32R2 in the discharge direction D1. When viewed in the width direction, each of the second elastic piece holding parts 32R2 overlaps the first elastic piece holding part 32R1.

Each of the second discharge member holding parts 32S2 is located downstream of each second elastic piece holding part 32R2 in the first direction DE1 and is located one step lower than each second elastic piece holding part 32R2. Each of the second discharge member holding parts 32S2 is an upwardly facing flat surface extending in the width direction and the first direction DE1. When viewed in the width direction, each of the second discharge member holding parts 32S2 overlaps the first discharge member holding part 32S1.

<Third Elastic Piece Holding Part and Guide Rib>

As illustrated in FIGS. 6 and 10, the supply tray 91 includes two third elastic piece holding parts 91R3 and six guide ribs 94. Each of the third elastic piece holding parts 91R3 and each of the guide ribs 94 are integrally formed on the back surface side of the first tray member 91A.

As illustrated in FIG. 6, the third elastic piece holding part 91R3 located on one side in the width direction is one surface of a convex portion that is located near one end in the width direction of the back surface side of the first tray member 91A and protrudes downwards. The third elastic piece holding part 91R3 located on the other side in the width direction is one surface of a convex portion located near the other end in the width direction on the back surface side of the first tray member 91A and protrudes downwards.

As illustrated in FIG. 10, each of the third elastic piece holding parts 91R3 is a downward flat surface extending in the width direction and a second direction DE2 at a position away from the shaft 49 upwards. The second direction DE2 is a direction that is perpendicular to the width direction and is inclined downwards while proceeding in the discharge direction D1, and is inclined downwards in the right direction. When viewed in the width direction, the second direction DE2 intersects the discharge direction D1 at a large angle. An abutting part 91RE3 extending in the width direction is provided at the upstream end of each of the third elastic piece holding parts 91R3 in the second direction DE2.

By providing each of the third elastic piece holding parts 91R3 on the back surface side of the first tray member 91A, a recess 91D is formed on the sheet placement surface side of the supply tray 91, as illustrated in FIGS. 5 and 10. In addition, molding shrinkage is likely to occur around the recess 91D on the sheet placement surface of the supply tray 91.

As illustrated in FIG. 5, when the side guides 92A and 92B are located to sandwich the sheet SH1 (for example, the smallest sheet SH1S) smaller than the largest sheet SH1L in the width direction, the sheet end edge support part 92C of each of the side guides 92A and 92B is located inwards in the width direction with respect to a portion at which the third elastic piece holding part 91R3 is located on the sheet placement surface of the supply tray 91, that is, the recess 91D and the surrounding molding shrinkage, and exposes the recess 91D and the like.

As illustrated in FIG. 2, when the side guides 92A and 92B sandwich and position the largest sheet SH1L in the width direction, the sheet end edge support part 92C of each of the side guides 92A and 92B covers, from above, a portion at which the third elastic piece holding part 91R3 is located on the sheet placement surface of the supply tray 91, that is, the recess 91D and the like.

As illustrated in FIG. 6, the three guide ribs 94 located on one side in the width direction are located between the center in the width direction on the back surface side of the first tray member 91A and one end in the width direction. The three guide ribs 94 located on the other side in the width direction are located between the center in the width direction on the back surface side of the first tray member 91A and the other end in the width direction.

The respective guide ribs 94 have the same shape when viewed in the width direction and are separated from each other in the width direction. As illustrated in FIG. 10, each of the guide ribs 94 protrudes downwards from the back surface side of the first tray member 91A and extends in the discharge direction D1.

A lower end edge 94E of each of the guide ribs 94 extends so as to be inclined downwards while proceeding in the discharge direction D1. The lower end edge 94E of each of the guide ribs 94 guides, from above, the sheet SH1 to be discharged toward the discharge tray 96.

<First Elastic Piece, Second Elastic Piece, and Third Elastic Piece>

As illustrated in FIGS. 4, 9, and 10, the conveyance unit 4 includes one first elastic piece 110, two second elastic pieces 120, and two third elastic pieces 130. The first elastic piece 110, each of the second elastic pieces 120, and each of the third elastic pieces 130 are each a plate-shaped piece made of a resin film.

The first elastic piece 110, each of the second elastic pieces 120, and each of the third elastic pieces 130 are manufactured by cutting out a substantially rectangular shape from, for example, a polyethylene terephthalate (PET) film or the like. The first elastic piece 110, each of the second elastic pieces 120, and each of the third elastic pieces 130 have a thickness capable of exerting a degree of rigidity that prevents each of the first to third elastic pieces 110 to 130 from bending when each of the first to third elastic pieces 110 to 130 comes into contact with the sheet SH1, and in the present embodiment, each of the first to third elastic pieces 110 to 130 is made of a PET film having a thickness of about 25 μm.

<Details of First Elastic Piece>

As illustrated in FIGS. 8 and 9, the first elastic piece holding part 32R1 holds an upstream end 110E of the first elastic piece 110 in the first direction DE1. Specifically, the upstream end 110E of the first elastic piece 110 is attached to the first elastic piece holding part 32R1 by double-sided tape while abutting on the abutting part 32RE1. By causing the upstream end 110E of the first elastic piece 110 to abut on the abutting part 32RE1, it is possible to prevent the first elastic piece 110 from being attached obliquely thereto in the discharge direction D1.

The first elastic piece 110 is located between the rollers 48 in the width direction, and is located above the shaft 49 at the position of the shaft 49. The first elastic piece 110 protrudes in the first direction DE1. The first elastic piece 110 protrudes linearly when viewed in the width direction.

As illustrated in FIG. 9, the downward surface of the first elastic piece 110 is a contact surface 110T that is configured to come into contact with the sheet SH1 guided by the first guide surface 31G and the second guide surface 32G.

A portion of the contact surface 110T located directly above the shaft 49 is located below the upper end 48A1 of the outer circumferential surface 48A of each of the rollers 48 in a state of not contacting the sheet SH1 guided by the first guide surface 31G and the second guide surface 32G.

A downstream end 110F of the first elastic piece 110 in the first direction DE1 is located downstream of a downstream end 48A2 of the outer circumferential surface 48A of each of the rollers 48 in the discharge direction D1. The downstream end 110F of the first elastic piece 110 is also located downstream of the upstream end of the discharge tray 96 in the discharge direction D1. Furthermore, the downstream end 110F of the first elastic piece 110 is located below the exposed portion 93E of the interlocking mechanism 93 and overlaps the exposed portion 93E in the discharge direction D1.

The first elastic piece 110 intersects the discharge path P1 in a state of not contacting the sheet SH1 guided by the first guide surface 31G and the second guide surface 32G. Furthermore, the first elastic piece 110 intersects the paddle 48P and each of the rollers 48 when viewed in the width direction in a state of not contacting the sheet SH1 guided by the first guide surface 31G and the second guide surface 32G.

<Details of Second Elastic Piece>

As illustrated in FIGS. 8 and 10, each of the second elastic piece holding parts 32R2 holds an upstream end 120E of each of the second elastic pieces 120 in the first direction DE1. Specifically, the upstream end 120E of each of the second elastic pieces 120 is attached to a corresponding one of the second elastic piece holding parts 32R2 by double-sided tape while abutting on the abutting part 32RE2. By causing the upstream end 120E of each of the second elastic pieces 120 to abut on the abutting part 32RE2, it is possible to prevent each of the second elastic pieces 120 from being obliquely attached thereto in the discharge direction D1.

Each of the second elastic pieces 120 is located so as to sandwich each of the rollers 48 in the width direction, and is located above the shaft 49 at the position of the shaft 49. Each of the second elastic pieces 120 protrudes in the first direction DE1, similarly to the first elastic piece 110. Each of the second elastic pieces 120 protrudes linearly when viewed in the width direction.

In FIG. 10, the first elastic piece 110 is illustrated by a two-dot chain line to make the drawing easier to view. Each of the second elastic pieces 120 overlaps the first elastic piece 110 when viewed in the width direction.

The downward surface of each of the second elastic pieces 120 is a contact surface 120T that can come into contact with the sheet SH1 guided by the first guide surface 31G and the second guide surface 32G.

A portion of each contact surface 120T located directly above the shaft 49 is located below the upper end 48A1 of the outer circumferential surface 48A of each of the rollers 48 in a state of not contacting the sheet SH1 guided by the first guide surface 31G and the second guide surface 32G.

A downstream end 120F of each of the second elastic pieces 120 in the first direction DE1 is located downstream of the upper end 48A1 of the outer circumferential surface 48A of each of the rollers 48 in the discharge direction D1, and is located upstream of the downstream end 110F of the first elastic piece 110 in the discharge direction D1. The downstream end 120F of each of the second elastic pieces 120 is also located upstream of the upstream end of the discharge tray 96 in the discharge direction D1.

Each of the second elastic pieces 120 intersects the discharge path P1 in a state of not contacting the sheet SH1 guided by the first guide surface 31G and the second guide surface 32G. Furthermore, each of the second elastic pieces 120 intersects the paddle 48P and each of the rollers 48 when viewed in the width direction in a state of not contacting the sheet SH1 guided by the first guide surface 31G and the second guide surface 32G.

As illustrated in FIG. 4, an outer end edge located on one side in the width direction in the second elastic piece 120 located on one side of the width direction is located more inwards in the width direction than an end edge located on one side in the width direction of the specific sheet SH1A. An outer end edge located on the other side in the width direction of the second elastic piece 120 located on the other side in the width direction is located more inwards in the width direction than an end edge located on the other side in the width direction of the specific sheet SH1A.

<Details of Third Elastic Piece>

As illustrated in FIGS. 6 and 10, each of the third elastic piece holding parts 91R3 holds an upstream end 130E of each of the third elastic pieces 130 in the second direction DE2. Specifically, the upstream end 130E of each of the third elastic pieces 130 is attached to a corresponding one of the third elastic piece holding parts 91R3 with double-sided tape while abutting on the abutting part 91RE3. By causing the upstream end 130E of each of the third elastic pieces 130 to about on the abutting part 91RE3, it is possible to prevent each of the third elastic pieces 130 from being obliquely attached thereto in the discharge direction D1.

Each of the third elastic pieces 130 is located so as to sandwich each of the rollers 48 in the width direction, and is located downstream of each of the second elastic pieces 120 in the discharge direction D1. Each of the third elastic pieces 130 protrudes in the second direction DE2 from a position above the first elastic piece 110 and each of the second elastic pieces 120. Each of the third elastic pieces 130 protrudes linearly when viewed in the width direction.

As illustrated in FIG. 10, a downstream end 130F of each of the third elastic pieces 130 in the second direction DE2 is located below the downstream end 110F of the first elastic piece 110 and the downstream end 120F of each of the second elastic pieces 120, and downstream in the discharge direction D1.

When viewed in the width direction, an angle α1 at which each of the third elastic pieces 130 intersects the horizontal direction is greater than an angle α2 at which the lower end edge 94E of each of the guide ribs 94 intersects the horizontal direction.

As illustrated in FIG. 4, the outer end edge located on one side in the width direction of the third elastic piece 130 located on one side in the width direction is located on the outer side in the width direction of an end edge located on one side in the width direction of the specific sheet SH1A. An outer end edge of the third elastic piece 130 located on the other side in the width direction, the outer end edge being located on the other side in the width direction, is located on the outer side of the end edge located on the other side in the width direction of the specific sheet SH1A.

<First Discharge Member, Second Discharge Member, Earth Connection Member, and Conductive Fiber for Confirming Conductivity>

As illustrated in FIG. 8, the conveyance unit 4 includes a first discharge member 141, two second discharge members 142, a conductive fiber for confirming conductivity 143, and an earth connection member 145.

The first discharge member 141 is a discharge brush in which conductive fibers 141A extending in the first direction DE1 are arranged discretely in the width direction. Each of the second discharge members 142 is a discharge brush in which conductive fibers 142A extending in the first direction DE1 are arranged discretely in the width direction. The conductive fibers 141A and 142A are made of very thin stainless steel wire.

The conductive fiber for confirming conductivity 143 is made of very thin stainless steel wire, similarly to the conductive fibers 141A and 142A, and extends in the first direction DE1.

The earth connection member 145 is a conductive aluminum tape. The earth connection member 145 extends in the width direction and is connected to an upstream end 141E of the first discharge member 141 in the first direction DE1 and an upstream end 142E of each of the second discharge members 142 in the first direction DE1.

One end 145A in the width direction of the earth connection member 145 is connected to the upstream end of the conductive fiber for confirming conductivity 143 in the first direction DE1 at a position separated in one direction in the width direction from the first elastic piece 110 and each of the second elastic pieces 120.

The earth connection member 145 is attached to the first discharge member holding part 32S1 and each of the second discharge member holding parts 32S2 along the first elastic piece holding part 32R1 and each of the second elastic piece holding parts 32R2 by double-sided tape, and is attached to a part of the upper sheet guide 32 that is aligned in the width direction with the first discharge member holding part 32S1 and each of the second discharge member holding parts 32S2. At this time, the earth connection member 145 is attached thereto in a state of abutting on the end surface of a step between the first elastic piece holding part 32R1 and the first discharge member holding part 32S1 and the end surface of a step between each of the second elastic piece holding part 32R2 and each of the second discharge member holding parts 32S2. As illustrated in FIG. 7, the drive frame 99 is connected to the other end 145B in the width direction of the earth connection member 145. Note that the attachment of the first elastic piece 110 to the first elastic piece holding part 32R1 and the attachment of each of the second elastic pieces 120 to each of the second elastic piece holding parts 32R2 are performed after this.

As a result, the upstream end 141E of the first discharge member 141 is attached to the first discharge member holding part 32S1. The upstream end 142E of each pf of the second discharge member 142 is attached to a corresponding one of the second discharge member holding parts 32S2.

As illustrated in FIGS. 8 and 9, the first discharge member 141 is disposed on the contact surface 110T side of the first elastic piece 110.

A downstream end 141F of the first discharge member 141 in the first direction DE1 is within a first range A1 from a position coinciding with the downstream end 48A2 of the outer circumferential surface 48A of each of the rollers 48 to a position coinciding with the downstream end 110F of the first elastic piece 110 in the discharge direction D1.

As illustrated in FIGS. 8 and 10, each of the second discharge members 142 is disposed on the contact surface 120T side of each of the second elastic pieces 120.

A downstream end 142F of each of the second discharge members 142 in the first direction DE1 is within a second range A2 from a position coinciding with the upper end 48A1 of the outer circumferential surface 48A of each of the rollers 48 to a position coinciding with the downstream end 120F of each of the second elastic pieces 120 in the discharge direction D1. In the present embodiment, the downstream end 142F of each of the second discharge members 142 is located at a position that, in the discharge direction D1, almost coincides with the upper end 48A1 of the outer circumferential surface 48A of each of the rollers 48 without protrusion thereof.

<Function>

In the image reading apparatus 1 of the first embodiment, in a case where the image reading unit 3 reads the image of the sheet SH1 supported on the supply tray 91, the feed roller 41, the separation roller 42, and the separation pad 42A of the conveyance unit 4 convey the sheet SH1 supported on the supply tray 91 one by one.

Next, the pair of first conveyance rollers 43 conveys the sheet SH1 guided by the first conveyance guide 35 and the second conveyance guide 36, and allows the sheet SH1 to pass through a portion located above the reading sensor 3S at the stationary reading position. As a result, the reading sensor 3S reads the image of the sheet SH1.

After that, the pair of second conveyance rollers 45 conveys the sheet SH1 guided by the first guide surface 31G and the second guide surface 32G toward the discharge roller 47. The roller 48, the first elastic piece 110, and the second elastic pieces 120 of the discharge roller 47 convey the sheet SH1 in the discharge direction D1 and discharge the sheet onto the discharge tray 96.

Figure 11:
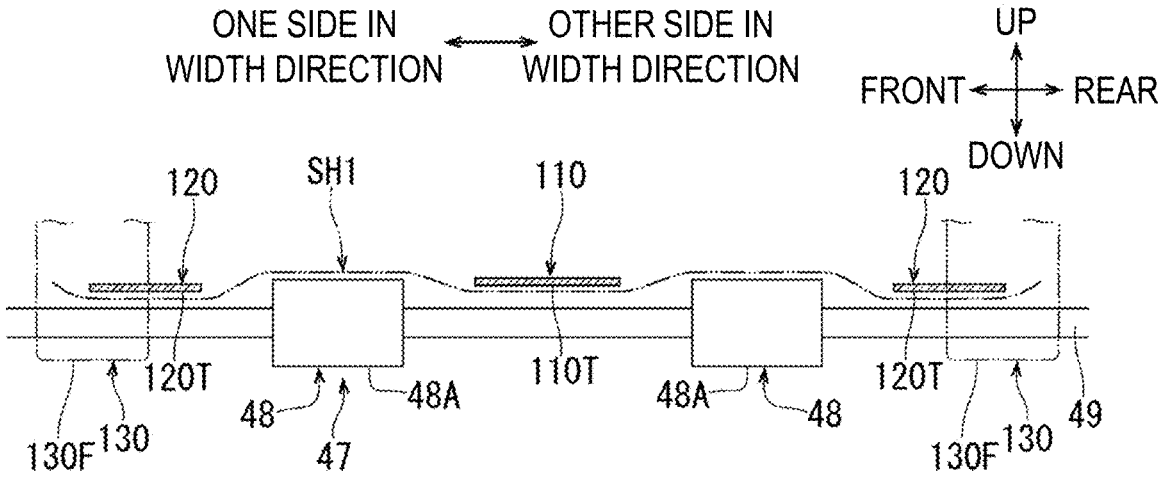
FIG. 11 is a schematic view illustrating the discharge roller and the first to third elastic pieces as viewed from downstream in the discharge direction.

Here, as illustrated in FIG. 11, the first elastic piece 110 and the second elastic pieces 120 deform the sheet SH1 discharged by the discharge roller 47 into a wavy shape when viewed in the discharge direction D1 so as to increase rigidity of the sheet SH1, and simultaneously press the sheet SH1 against the outer circumferential surface 48A of the roller 48.

As a result, the discharge roller 47, the first elastic piece 110, and each of the second elastic pieces 120 can increase the amount of sheets SH1 to be stacked, discharge the sheet SH1 with high reliability, and stabilize the posture of the sheets SH1 when discharged, as compared with a case in which there is only the pair of second conveyance rollers 45.

Then, each of the third elastic pieces 130 presses the discharged sheet SH1 toward the discharge tray 96, prevents the sheet SH1 from curling into a downwardly convex cylindrical shape, and drops the sheet SH1 onto the discharge tray 96.

Furthermore, as the number of sheets SH1 supported on the discharge tray 96 increases, when the downstream end 130F of the third elastic piece 130 comes into contact with the uppermost sheet SH1 supported on the discharge tray 96, the third elastic piece 130 rises, whereas the first elastic piece 110 and each of the second elastic pieces 120 press the sheet SH1 against the outer circumferential surface 48A of the roller 48 without coming into contact with the uppermost sheet SH1 supported on the discharge tray 96.

As a result, the image reading apparatus 1 can suppress changes in the stacking order of the sheets SH1 discharged onto the discharge tray 96 and clogging of the sheets SH1.

Furthermore, in the image reading apparatus 1, there are no components located above the roller 48, in which the components correspond to a first discharge roller body and a first rotating shaft of the conventional sheet discharge apparatus.

Therefore, the image reading apparatus 1 of the first embodiment can achieve, with a simple configuration, a thin vertical configuration and improved stacking performance of the sheets SH1 to be discharged onto the discharge tray 96.

Furthermore, in the image reading apparatus 1, as illustrated in FIG. 6 and FIG. 10, each of the third elastic piece holding parts 91R3 is integrally formed on the back surface side of the first tray member 91A of the supply tray 91. With this configuration, the upstream end 130E of each of the third elastic pieces 130 can be held by each of the third elastic piece holding parts 91R3 arranged by utilizing an empty space originally present on the back surface side of the supply tray 91, so that the vertical thinning can be realized with high reliability.

Furthermore, in this image reading apparatus 1, as illustrated in FIG. 10, the downstream end 110F of the first elastic piece 110 is located below the exposed portion 93E of the interlocking mechanism 93 and is located at a position allowing overlapping the exposed portion 93E in the discharge direction D1. With this configuration, the first elastic piece 110 has a length sufficient to allow the downstream end 110F of the first elastic piece 110 to abut against the exposed portion 93E of the interlocking mechanism 93 from below when the first elastic piece 110 is pushed by the sheet SH1 guided by the first guide surface 31G and the second guide surface 32G and is bent upwards. As a result, this image reading apparatus 1 can prevent the sheet SH1, which is guided by the first guide surface 31G and discharged, from getting caught on the exposed portion 93E of the interlocking mechanism 93.

In addition, in this image reading apparatus 1, the angle $\alpha 1$ at which each of the third elastic pieces 130 intersects the horizontal direction when viewed in the width direction is greater than the angle $\alpha 2$ at which the lower end edge 94E of each of the guide ribs 94 intersects the horizontal direction. With this configuration, since the third elastic piece 130, which is inclined downwards at an angle greater than the lower end edge 94E of each of the guide ribs 94, can reliably hold the discharged sheet SH1 toward the discharge tray 96, the sheet SH1 can be reliably prevented from curling into a cylindrical shape causing a downwardly convex shape of the sheet.

Furthermore, in this image reading apparatus 1, as illustrated in FIG. 2, when the side guides 92A and 92B sandwich and position the largest sheet SH1L in the width direction, the sheet end edge support part 92C of each of the side guide 92A and 92B covers, from above, a portion of the sheet placement surface of the supply tray 91, in which each of the third elastic piece holding parts 91R3 is located on the portion. By providing each of the third elastic piece holding parts 91R3 on the back surface side of the first tray member 91A, as illustrated in FIG. 6, the recess 91D or shrinkage due to molding is likely to occur on the sheet placement surface side of the supply tray 91, and there is a risk that the leading edge of the sheet SH1 may get caught in the recess 91D and the like. In this point, when the side guides 92A and 92B locate the largest sheet SH1L to determine the position thereof, the above configuration makes it possible to prevent the leading edge of the sheet SH1 from getting caught in the recess 91D and the like. As illustrated in FIG. 5, when the side guides 92A and 92B locate the sheet SH1 narrower than the largest sheet SH1L to determine the position of the sheet SH1, the recesses 91D and the like are positioned on the outer sides of the side guides 92A and 92B in the width direction, so that the leading edge of the sheet SH1 does not get caught in the recesses 91D and the like.

As illustrated in FIG. 4, the image reading apparatus 1 can discharge sheets SH1 having a plurality of sizes, including the specific sheet SH1A, the width direction length of which is a predetermined length WL1, toward the discharge tray 96. The outer end edge of each of the second elastic pieces 120 in the width direction is located on the inner side in the width direction of the end edge in the width direction of the specific sheet SH1A. The outer end edge of each of the third elastic pieces 130 in the width direction is located on the outer side in the width direction of the end edge in the width direction of the specific sheet SH1A. With this configuration, when the specific sheet SH1A curls into a cylindrical shape causing a downwardly convex shape of the specific sheet, the second elastic pieces 120 and the third elastic pieces 130 can reliably hold down the end edge of the specific sheet SH1A in the width direction.

Furthermore, in this image reading apparatus 1, the first elastic piece 110 and the second elastic pieces 120 are each made of a resin film. The first discharge member 141 is disposed on the contact surface 110T side of the first elastic piece 110, and each of the second discharge members 142 is disposed on the contact surface 120T side of each of the second elastic pieces 120. With this configuration, the first discharge member 141 and each of the second discharge members 142 can remove static electricity accumulated in the first elastic piece 110 and each second elastic piece 120 by contacting the sheet SH1. As a result, it is possible to prevent the discharged sheet SH1 from sticking to the first elastic piece 110 and each of the second elastic pieces 120.

In addition, in this image reading apparatus 1, as illustrated in FIG. 8, the first discharge member 141 and each of the second discharge members 142 are discharge brushes in which conductive fibers 141A and 142A each extending in the first direction DE1 are arranged discretely in the width direction. With this configuration, friction with the sheet SH1 is less likely to concentrate on the discretely arranged conductive fibers 141A and 142A, and excessive wear of the conductive fibers 141A and 142A can be suppressed.

Furthermore, in this image reading apparatus 1, as illustrated in FIG. 9, the downstream end 110F of the first elastic piece 110 is located downstream of the downstream end 48A2 of the outer circumferential surface 48A of each of the rollers 48 in the discharge direction D1. The downstream end 141F of the first discharge member 141 is within the first range A1 from a position coinciding with the downstream end 48A2 of the outer circumferential surface 48A of each of the rollers 48 in the discharge direction D1 to a position coinciding with the downstream end 110F of the first elastic piece 110. When removing the sheet SH1 jammed around the discharge roller 47, a user can easily touch the first elastic piece 110. When the downstream end 141F of the first discharge member 141 protrudes downstream from the downstream end 110F of the first elastic piece 110 in the discharge direction D1, there is a risk that the user may pull the downstream end 141F of the first discharge member 141 together with the jammed sheet SH1. In this point, the above configuration can prevent the downstream end 141F of the first discharge member 141 from being pulled. In addition, since the downstream end 141F of the first discharge member 141 is located downstream of a range within which the first discharge member 141 is likely to come into contact with the sheet SH1, the static electricity accumulated in the first elastic piece 110 can be removed with high reliability by the first discharge member 141.

In addition, in this image reading apparatus 1, as illustrated in FIG. 10, the downstream end 120F of each of the second elastic pieces 120 is located downstream of the upper end 48A1 of the outer circumferential surface 48A of each of the rollers 48 in the discharge direction D1, and is located upstream of the downstream end 110F of the first elastic piece 110 in the discharge direction D1. The downstream end 142F of each of the second discharge members 142 is within the second range A2 from a position coinciding with the upper end 48A1 of the outer circumferential surface 48A of each of the rollers 48 to a position coinciding with the downstream end 120F of each of the second elastic pieces 120 in the discharge direction D1. When removing the sheet SH1 jammed around the discharge roller 47, the user can easily touch each of the second elastic pieces 120. When the downstream end 142F of each of the second discharge members 142 protrudes downstream from the downstream end 120F of each of the second elastic pieces 120 in the discharge direction D1, the user may pull the downstream end 142F of each of the second discharge members 142 together with the jammed sheet SH1. In this point, the above configuration can prevent the downstream end 142F of each of the second discharge members 142 from being pulled. In addition, since the downstream end 142F of each of the second discharge members 142 is located downstream of a range in which each of the second discharge members 142 is likely to come into contact with the sheet SH1, the static electricity accumulated in each of the second elastic pieces 120 can be removed with high reliability by each of the second discharge members 142.

Furthermore, in this image reading apparatus 1, as illustrated in FIGS. 9 and 10, the first elastic piece 110 and each of the second elastic pieces 120 intersect the discharge path P1 in a state of not contacting the sheet SH1 guided by the first guide surface 31G and the second guide surface 32G. With this configuration, the first elastic piece 110 and each of the second elastic pieces 120 can highly reliably press the sheet SH1 discharged by the discharge roller 47 against the outer circumferential surface 48A of each of the rollers 48 while deforming the sheet SH1 into a wavy shape when viewed in the discharge direction D1 so as to increase rigidity of the sheet SH1. As a result, conveyance force of each of the rollers 48 can be transmitted to the sheet SH1 with high reliability.

Furthermore, in this image reading apparatus 1, as illustrated in FIGS. 9 and 10, the upstream end 110E of the first elastic piece 110 is attached to the first elastic piece holding part 32R1. The upstream end 120E of each of the second elastic pieces 120 is attached to a corresponding one of the second elastic piece holding parts 32R2. The first discharge member holding part 32S1 is located downstream of the first elastic piece holding part 32R1 in the first direction DE1 and is located one step lower than the first elastic piece holding part 32R1. The upstream end 141E of the first discharge member 141 is attached to the first discharge member holding part 32S1. Each of the second discharge member holding parts 32S2 is located downstream of each second elastic piece holding part 32R2 in the first direction DE1 and is located one step lower than each second elastic piece holding part 32R2. The upstream end 142E of each of the second discharge members 142 is attached to a corresponding one of the second discharge member holding parts 32S2. When the upstream end 141E of the first discharge member 141 is attached to the upper sheet guide 32 and the upstream end 110E of the first elastic piece 110 is attached thereon, the upstream end 110E of the first elastic piece 110 is likely to peel off due to unevenness of the conductive fiber 141A of the first discharge member 141. When the upstream end 142E of each of the second discharge members 142 is attached to the upper sheet guide 32 and the upstream end 120E of each of the second elastic pieces 120 is attached thereon, the upstream end 120E of each of the second elastic pieces 120 is likely to peel off due to unevenness of the conductive fiber 142A of each of the second discharge members 142. In this point, the above configuration can suppress peeling of the upstream ends 110E and 120E of the first elastic piece 110 and each of the second elastic pieces 120.

Furthermore, in this image reading apparatus 1, as illustrated in FIG. 8, the earth connection member 145 is connected to the upstream end 141E of the first discharge member 141 and the upstream end 142E of each of the second discharge members 142. One end 145A in the width direction of the earth connection member 145 is connected to the conductive fiber for confirming conductivity 143. As illustrated in FIG. 7, the conductive drive frame 99 is connected to the other end 145B in the width direction of the earth connection member 145. With this configuration, the grounding state of the first discharge member 141 and each of the second discharge members 142 can be confirmed by measuring the potential of the conductive fiber for confirming conductivity 143.

Furthermore, in this image reading apparatus 1, as illustrated in FIGS. 9 and 10, the first elastic piece 110 and each of the second elastic pieces 120 intersect the paddle 48P and each of the rollers 48 when viewed in the width direction without contacting the sheet SH1 guided by the first guide surface 31G and the second guide surface 32G. With this configuration, the first elastic piece 110 and each of the second elastic pieces 120 can highly reliably press the sheet SH1 discharged by the discharge roller 47 against the outer circumferential surface 48A of each of the rollers 48 and the paddle 48P while deforming the sheet SH1 into a wavy shape when viewed in the discharge direction D1 so as to increase rigidity of the sheet SH1. As a result, conveyance force of each of the rollers 48 can be transmitted to the sheet SH1 with high reliability.

Second Embodiment

Figure 12:
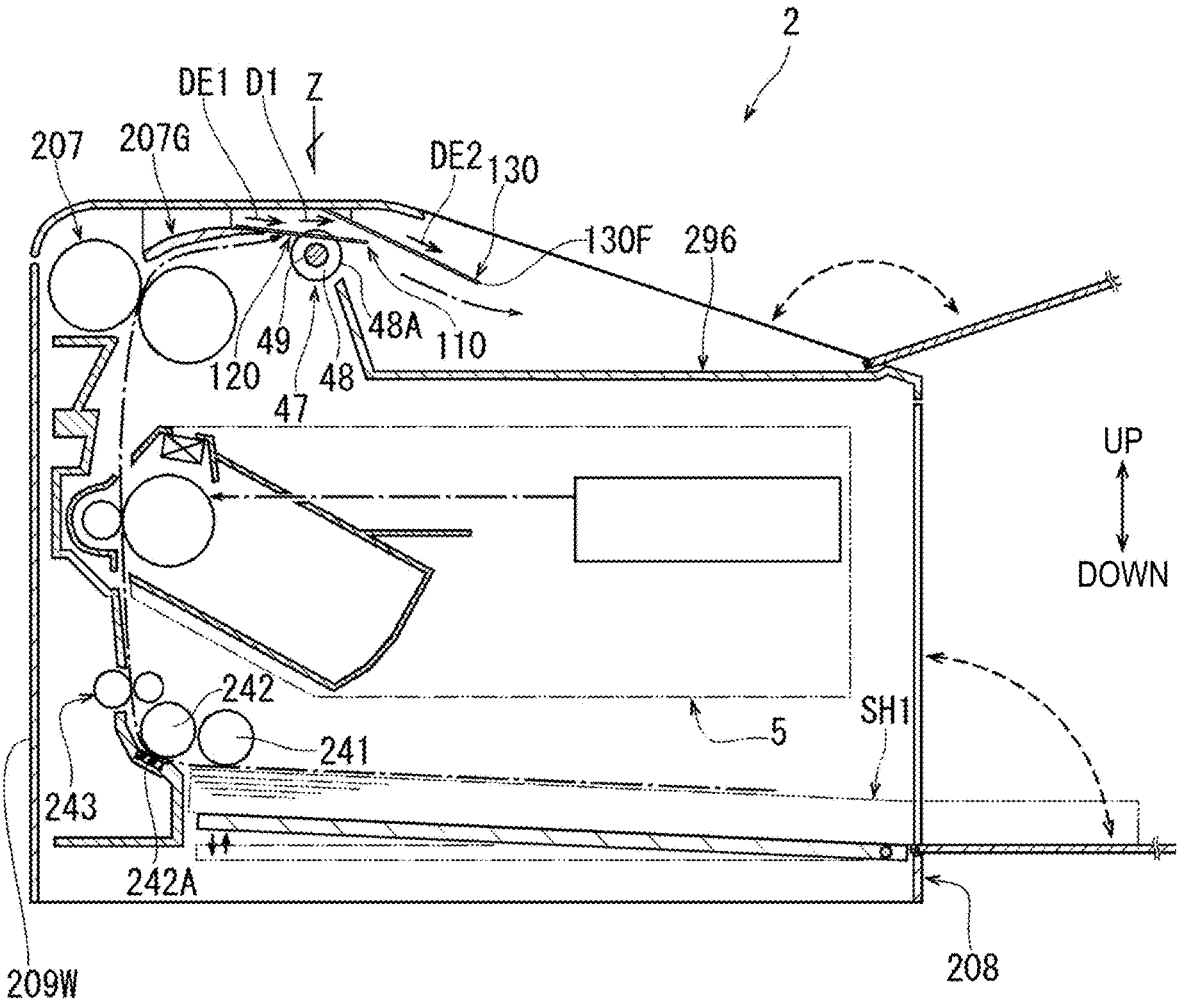
FIG. 12 is a perspective view of an image forming apparatus according to a second embodiment.

As illustrated in FIG. 12, an image forming apparatus 2 of a second embodiment is an example of a specific aspect of a sheet conveyance apparatus of the present disclosure.

In the image forming apparatus 2, an image forming unit 5 is located in the center of a housing 208. Sheets SH1 are stored in a stacked state at a lower portion of the housing 208. A discharge tray 296 is formed on the upper surface of the housing 208.

A feed roller 241, a separation roller 242, a separation pad 242A, and a pair of conveyance rollers 243 are located on a side wall 209W side in the housing 208 and are located at a lower portion of the side wall. A fuser 207 and a discharge guide 207G are located on the side wall 209W side in the housing 208 and are located at an upper portion of the side wall.

The feed roller 241, the separation roller 242, and the separation pad 242A is configured to feed the sheets SH1 one by one. The pair of conveyance rollers 243 is configured to convey the sheets SH1 upwards. The image forming unit 5 is configured to transfer a toner image to the sheet SH1 by a laser method.

The fuser 207 is configured to heat and press the sheet SH1 to which the toner image has been transferred, and fixes the toner image to the sheet SH1. The discharge guide 207G is configured to guide the sheet SH1 that has passed through the fuser 207 in a discharge direction D1.

In the present embodiment, the discharge direction D1 is a direction that advances approximately horizontally toward the discharge tray 296. The discharge tray 296 is located lower than the fuser 207 and the discharge guide 207G. In FIG. 12, a width direction perpendicular to the discharge direction D1 is a direction perpendicular to the paper surface.

Figure 13:
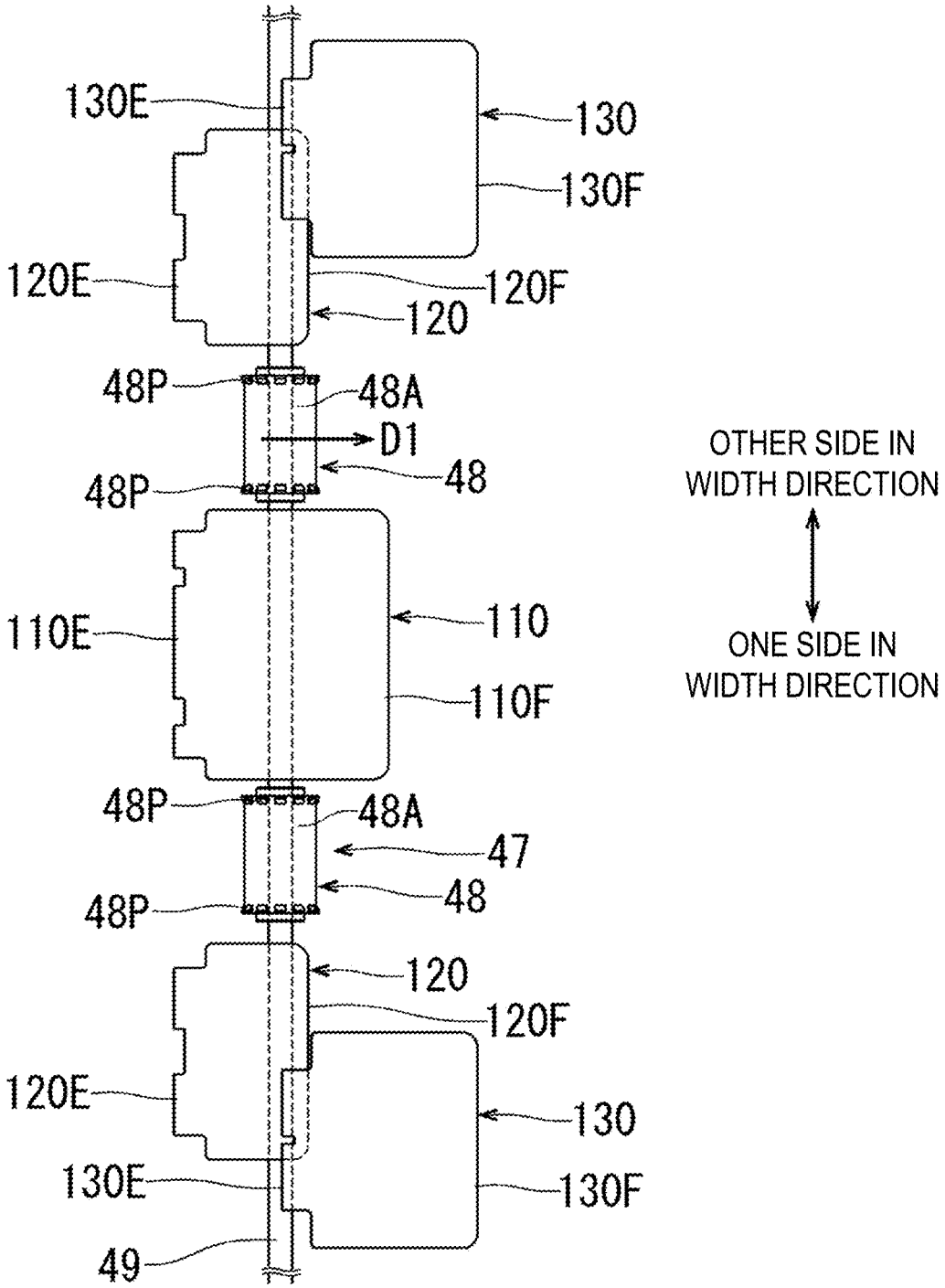
FIG. 13 is a top view of the discharge roller and the first to third elastic pieces as viewed from the direction of an arrow Z in FIG. 12.

As illustrated in FIGS. 12 and 13, a discharge roller 47, a first elastic piece 100, two second elastic pieces 120, and two third elastic pieces 130 are located downstream of a discharge guide 207G in the discharge direction D1 inside the housing 208.

The configurations of the discharge roller 47, the first elastic piece 100, the two second elastic pieces 120, and the two third elastic pieces 130 are the same as those in the first embodiment, and only the installed device and the holding configuration are different. For example, the first elastic piece 100 and each of the second elastic pieces 120 are held by the discharge guide 207G. Each of the third elastic pieces 130 is held on the back surface side of the upper wall of the housing 208. For this reason, a description of the specific configurations of the discharge roller 47, the first elastic piece 100, each of the second elastic pieces 120, and each of the third elastic pieces 130 will be omitted.

In the image forming apparatus 2 of the second embodiment having such a configuration, the first elastic piece 110 and each of the second elastic pieces 120 deform the sheet SH1 discharged by the discharge roller 47 into a wavy shape when viewed in the discharge direction D1 so as to increase rigidity of the sheet SH1, and simultaneously press the sheet SH1 against an outer circumferential surface 48A of a roller 48.

As a result, the discharge roller 47, the first elastic piece 110, and each of the second elastic pieces 120 can discharge the sheet SH1 with high reliability, and can stabilize the posture of the sheet SH1 when discharged.

Then, each of the third elastic pieces 130 presses the discharged sheet SH1 toward the discharge tray 296 so as to prevent the sheet SH1 from curling into a cylindrical shape causing a downwardly convex shape of the sheet, and simultaneously drops the sheet SH1 onto the discharge tray 296.

Furthermore, as the number of sheets SH1 supported on the discharge tray 296 increases, when a downstream end 130F of the third elastic piece 130 comes into contact with the uppermost sheet SH1 supported on the discharge tray 296, the third elastic piece 130 rises, whereas the first elastic piece 110 and each of the second elastic pieces 120 press the sheet SH1 against the outer circumferential surface 48A of the roller 48 without coming into contact with the uppermost sheet SH1 supported on the discharge tray 296.

As a result, the image forming apparatus 2 can suppress changes in the stacking order of the sheets SH1 discharged onto the discharge tray 296 and clogging of the sheets SH1.

Furthermore, in the image forming apparatus 2, there are no components located above the roller 48, in which the components correspond to a first discharge roller body and a first rotating shaft of the conventional sheet discharge apparatus.

Therefore, similarly to the image reading apparatus 1 of the first embodiment, the image forming apparatus 2 of the second embodiment can achieve, with a simple configuration, a thin vertical configuration and improved stacking performance of the sheet SH1 to be discharged onto the discharge tray 296.

Although the present disclosure has been described above in accordance with the first and second embodiments, it goes without saying that the present invention is not limited to the first and second embodiments, and can be appropriately modified without departing from the spirit of the present invention.

In the first embodiment, the first direction DE1 intersects the discharge direction D1 at a small angle when viewed in the width direction, but the present invention is not limited to this configuration. For example, the present invention also includes a configuration in which the first direction is parallel to the discharge direction when viewed in the width direction.

In the first embodiment, the first elastic piece 110 is attached to the first elastic piece holding part 32R1, and each of the second elastic pieces 120 is attached to a corresponding one of the second elastic piece holding parts 32R2, but the present invention is not limited to this configuration. For example, the present invention also includes a configuration in which the first elastic piece holding part holds the first elastic piece, and a configuration in which each of the second elastic piece holding parts holds a corresponding one of the second elastic pieces.

In the first embodiment, the first discharge member 141 is attached to the first discharge member holding part 32S1, and each of the second discharge members 142 is attached to a corresponding one of the second discharge member holding parts 32S2, but the present invention is not limited to this configuration. For example, the present invention also includes a configuration in which the first discharge member is attached to the first elastic piece, and a configuration in which each of the second discharge members is attached to a corresponding one of the second elastic pieces.

What is claimed is:

1. A sheet conveyance apparatus comprising:

a lower sheet guide including a first guide surface configured to guide a surface of a sheet, the surface facing downwards;

a discharge roller including:

two rollers configured to convey the sheet guided by the first guide surface in a discharge direction, a part of each of the two rollers protruding above the first guide surface; and a shaft extending in a width direction perpendicular to the discharge direction, the two rollers being spaced apart from each other in the width direction and being rotated integrally with the shaft;

a discharge tray configured to support the sheet guided by the first guide surface and discharged from the discharged roller;

a first elastic piece located between the two rollers in the width direction and located above the shaft at a position of the shaft, the first elastic piece protruding in a first direction along the discharge direction, the first direction being perpendicular to the width direction;

a plurality of second elastic pieces located so as to sandwich the two rollers in the width direction and located above the shaft at the position of the shaft, the second elastic pieces protruding in the first direction; and a plurality of third elastic pieces located so as to sandwich the two rollers in the width direction and located downstream of the second elastic pieces in the discharge direction, the third elastic pieces protruding in a second direction from a position above the first elastic piece and the second elastic pieces, the second direction being perpendicular to the width direction and inclined downwards toward the discharge direction, wherein surfaces of the first elastic piece and the second elastic pieces are contact surfaces configured to contact the sheet guided by the first guide surface, the surfaces facing downwards, in a state where the contact surfaces are not in contact with the sheet guided by the first guide surface, portions of the respective contact surfaces are located below upper ends of outer circumferential surfaces of the respective two rollers, the portions being located directly above the shaft, and downstream ends of the third elastic pieces in the second direction are located downstream in the discharge direction of and located below a downstream end of the first elastic piece in the first direction and downstream ends of the second elastic pieces in the first direction.

2. The sheet conveyance apparatus according to claim 1, further comprising a supply tray on which the sheet is placed, the supply tray being located above the discharge tray, wherein the supply tray includes a plurality of third elastic piece holding parts provided on a back surface side of the supply tray, the third elastic piece holding parts being configured to hold upstream ends of the respective third elastic pieces in the second direction.

3. The sheet conveyance apparatus according to claim 2, wherein the supply tray includes:

two side guides configured to sandwich and position the sheet to be placed on the supply tray in the width direction; and an interlocking mechanism configured to move the two side guides such that the two side guides are closer to each other or are spaced apart from each other in the width direction, the interlocking mechanism including an exposed portion exposed on the back surface side of the interlocking mechanism, and the downstream end of the first elastic piece is located below the exposed portion of the interlocking mechanism and overlaps the exposed portion in the discharge direction.

4. The sheet conveyance apparatus according to claim 2, wherein the supply tray includes a guide rib provided on the back surface side of the supply tray, formed to protrude downwards, and formed to extend in the discharge direction, the guide rib guiding the discharged sheet with a lower end edge of the guide rib from above, the lower end edge being formed to be inclined downwards toward the discharge direction, and when viewed in the width direction, an angle at which each of the third elastic pieces intersects the horizontal direction is greater than an angle at which the lower end edge of the guide rib intersects the horizontal direction.

5. The sheet conveyance apparatus according to claim 2, wherein the supply tray is configured to place sheets having a plurality of sizes on the supply tray, the sheets including a largest sheet having a largest length in the width direction, the supply tray includes:

two side guides configured to sandwich and position the sheets placed on the supply tray in the width direction; and an interlocking mechanism configured to move the two side guides such that the two side guides are closer to each other or are spaced apart from each other in the width direction, the two side guides include respective sheet end edge support parts configured to support, from below, an end edge in the width direction of the sheets placed on the supply tray, and in a case where the two side guides sandwich and position the largest sheet in the width direction, the sheet end edge support parts cover respective portions of a sheet placement surface of the supply tray from above, the third elastic piece holding parts being located at the respective portions of the sheet placement surface.

6. The sheet conveyance apparatus according to claim 1, wherein the sheet conveyance apparatus is configured to discharge, toward the discharge tray, sheets having a plurality of sizes, the sheets including a specific sheet having a predetermined length in the width direction, each of the second elastic pieces includes an outer end edge in the width direction, the outer end edge being located inside an end edge of the specific sheet in the width direction, and each of the third elastic pieces includes an outer end edge in the width direction, the outer end edge being located outside the end edge of the specific sheet in the width direction.

7. The sheet conveyance apparatus according to claim 1, wherein the first elastic piece and the second elastic pieces are made of a resin film, the sheet conveyance apparatus further comprising:

a first discharge member disposed on a side of the contact surface of the first elastic piece; and a plurality of second discharge members disposed on sides of the contact surfaces of the respective second elastic pieces.

8. The sheet conveyance apparatus according to claim 7, wherein each of the first discharge member and the second discharge members is a discharge brush in which conductive fibers extending in the first direction are discretely arranged in the width direction.

9. The sheet conveyance apparatus according to claim 8, wherein the downstream end of the first elastic piece in the first direction is located downstream of downstream ends of the outer circumferential surfaces of the respective two rollers in the discharge direction, and the downstream end of the first discharge member in the first direction is located within a first range, the first range being defined from a position coinciding with the downstream ends of the outer circumferential surfaces of the respective two rollers in the discharge direction to a position coinciding with the downstream end of the first elastic piece in the first direction.

10. The sheet conveyance apparatus according to claim 9, wherein the downstream ends of the respective second elastic pieces in the first direction are located downstream of the upper ends of the outer circumferential surfaces of the respective two rollers in the discharge direction and are located upstream of the downstream end in the first direction of the first elastic piece in the discharge direction, and the downstream ends of the respective second discharge members in the first direction are located within a second range, the second range being defined from a position coinciding with the upper ends of the outer circumferential surfaces of the respective two rollers in the discharge direction to a position coinciding with the downstream ends of the respective second elastic pieces.

11. The sheet conveyance apparatus according to claim 8, further comprising an upper sheet guide having a second guide surface facing the first guide surface from above, the second guide surface being configured to guide a surface of the sheet, the surface facing upwards, wherein a discharge path is provided between the first guide surface and the second guide surface, the upper sheet guide includes:

a first elastic piece holding part extending in the width direction and the first direction, the first elastic piece holding part being configured to hold an upstream end of the first elastic piece in the first direction; and a plurality of second elastic piece holding parts extending in the width direction and the first direction, the second elastic piece holding parts being configured to hold upstream ends of the respective second elastic pieces in the first direction, and the first elastic piece and each of the second elastic pieces intersect the discharge path, in a state of not contacting the sheet guided by the first guide surface.

12. The sheet conveyance apparatus according to claim 11, wherein the upstream end of the first elastic piece is put on the first elastic piece holding part, the upstream ends of the second elastic pieces are put on the respective second elastic piece holding parts, and the upper sheet guide includes:

a first discharge member holding part located downstream of the first elastic piece holding part in the first direction and located one step lower than the first elastic piece holding part, the first discharge member holding part extending in the width direction and the first direction, the upstream end of the first discharge member in the first direction being put on the first discharge member holding part; and a plurality of second discharge member holding parts located downstream of the respective second elastic piece holding parts in the first direction and located one step lower than the respective second elastic piece holding parts, the second discharge member holding parts extending in the width direction and the first direction, the upstream ends of the second discharge members in the first direction being put on the respective second discharge member holding parts.

13. The sheet conveyance apparatus according to claim 8, further comprising:

an earth connection member extending in the width direction, and connected to an upstream end of the first discharge member in the first direction and to upstream ends of the respective second discharge members in the first direction;

a drive motor configured to generate driving force transmitted to the shaft; and a conductive drive frame configured to support the drive motor, wherein the earth connection member includes one end in the width direction, the one end being connected to a conductive fiber for confirming conductivity extending in the first direction at a position of one side in the width direction, the position being away from the first elastic piece and the respective second elastic pieces, and the drive frame is located closer to an other side in the width direction than to the first guide surface and is connected to an other end of the earth connection member in the width direction.

14. The sheet conveyance apparatus according to claim 1, wherein the discharge roller includes a paddle formed of a plurality of protrusions protruding outwards in a radial direction of the shaft from a circumferential end edge in the width direction on the outer circumferential surfaces of the respective two rollers, the protrusions being arranged with intervals between the protrusions in a circumferential direction of the shaft, and the first elastic piece and the respective second elastic pieces intersect, when viewed in the width direction, the paddle and the respective rollers in a state of not contacting the sheet guided by the first guide surface.

* * * * *